US008146473B2

(12) United States Patent
Mullikin

(10) Patent No.: US 8,146,473 B2
(45) Date of Patent: Apr. 3, 2012

(54) TOOL PRESS DRIVE

(75) Inventor: Jeffrey A. Mullikin, Andrews, SC (US)

(73) Assignee: Peddinghaus Corporation, Bradley, IL (US)

( * ) Notice: Subject to any disclaimer, the term of this patent is extended or adjusted under 35 U.S.C. 154(b) by 403 days.

(21) Appl. No.: 12/609,527

(22) Filed: Oct. 30, 2009

(65) Prior Publication Data

US 2011/0100184 A1 May 5, 2011

(51) Int. Cl.
*B26D 7/00* (2006.01)
*B21D 37/10* (2006.01)

(52) U.S. Cl. ..... 83/685; 83/859; 83/405; 83/635

(58) Field of Classification Search ..... 83/685, 83/686, 620, 639.5, 859, 405, 635, 667, 669, 83/698.91, 681, 682, 439, 560; 144/2.1, 144/3.1, 1.1, 242.1, 250.23, 196, 197; 29/465, 29/563, 564, 565, 34 R
See application file for complete search history.

(56) References Cited

U.S. PATENT DOCUMENTS

| | | | | |
|---|---|---|---|---|
| 2,387,027 | A * | 10/1945 | Jackson | 83/685 |
| 2,816,608 | A * | 12/1957 | Farmwald et al. | 83/529 |
| 3,198,052 | A * | 8/1965 | Persson | 83/516 |
| 3,554,060 | A * | 1/1971 | Gargrave et al. | 76/107.1 |
| 5,502,994 | A * | 4/1996 | Katoh et al. | 72/327 |
| 5,896,773 | A | 4/1999 | Lee | |
| 7,418,773 | B2 | 9/2008 | Simek | |
| 2009/0188364 | A1 * | 7/2009 | Lahtinen | 83/549 |

FOREIGN PATENT DOCUMENTS

| | | |
|---|---|---|
| EP | 1602471 A1 | 12/2005 |
| EP | 1952936 A2 | 8/2008 |
| WO | WO 96/27457 | 9/1996 |

OTHER PUBLICATIONS

Description of Die Supports, including Peddinghaus 600 and 800 Series Shear Lift, Peddinghaus 600 Series Punch Die Raise, and Controlled Automation Punch Frame Lift (5 pages).
Communication dated Feb. 23, 2011 received from the European Patent Office enclosing the extended European Search Report for the European application No. 10186534.3-2302.

* cited by examiner

*Primary Examiner* — Phong Nguyen
(74) *Attorney, Agent, or Firm* — Wood, Philliips, Katz, Clark & Mortimer

(57) ABSTRACT

A machine for creating holes in a structural angle, including parallel plates including (1) an earth plate perpendicular to an axial direction and positionable at a fixed position relative to the structural angle, (2) a top plate mounting a workpiece tool, (3) a bottom plate spaced a fixed distance from the top plate, both plates being supported for axial movement relative to the earth plate, and (4) a support plate between the earth plate and the top plate and supported for axial movement relative to the earth plate. The support plate is biased toward the top plate and away from the earth plate. A first stop limits movement of the bottom plate toward the earth plate and a second stop limits movement of the support plate away from the earth plate. A drive selectively moves the support and bottom plates axially away from each other.

29 Claims, 18 Drawing Sheets

TOOL PRESS DRIVE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a pressing mechanism for a workpiece tool particularly usable to work on a metal workpiece, such as a structural angle, for stamping, creating holes, cutting and shearing.

BACKGROUND OF THE INVENTION AND TECHNICAL PROBLEMS POSED BY THE PRIOR ART

Structural modifications for specific intended uses during manufacture of the workpieces are commonly required. For example, angle irons or structural angles (i.e., angle irons) often require that multiple holes be provided at various locations along the angles. Given the strength of the materials of the angles, significant forces are commonly required to create those holes, and thus significant mechanisms are required to generate those forces. Such forces are similarly required for other operations which might be required in which holes completely through the angle may not be required, for example, stamping identifying characters in the surface of the angle.

Machines have, of course, been used which can create holes (e.g., by punching or drilling), or stamp identifying information, in such workpieces, usually in a facility where the workpieces are being worked on (e.g., where a long blank is being punched to provide whatever holes are required for the intended use of the part pieces, with individual elements being sheared from the blank to form the individual part pieces).

Workpieces such as structural angles which are not simply flat and/or are made of strong material can be particularly difficult to work with in creating holes. For example, structural angles may have two longitudinal members or legs connected at right angles along an edge (often by bending a single flat longitudinal member along a line extending in the longitudinal direction), and typically are made of strong metals such as steel or iron to provide the strength required in many construction and manufacturing applications. In order to create holes in both of the legs of structural angles, separate punches have been used for each the two different legs of the angle, with one punch for one leg of the angle and a separate punch for the other leg of the angle. Those punches have shared a mechanism which serves to properly position the angle lengthwise for punching (e.g., along the X-axis), and have their own separate drives to move each individual punch head assembly to the correct location (along the Y- and Z-axes) for punching a hole at the selected longitudinal location of the structural angle. Not only can the cost of such dual punches be significant, but the speed of operation is also impacted since clearance requires that the punch head assemblies be spaced along the X-axis, resulting in time being required to move the entire structural angle along the X-axis for punching holes in both legs of the angle, even if the holes are at the same position along that X-axis. Further, precise positioning of holes which are supposed to be at the same longitudinal position on the angle may not be achieved if the structural angle is not moved accurately along its X-axis between the different punches.

Additionally, the operation of punch mechanisms for structural angles used heretofore have either resulted in inefficient handling of the structural angles or required additional mechanisms for the punch. That is, some machines have positioned the die portion of the punch so that it is always positioned so that it will be contacting one side of the angle (as desired during punching operation). However, such positioning necessarily results in the angle dragging on the punch die when it is moved through the mechanism. While such undesirable dragging has been avoided by either using support rollers which swing up to support the material clear of the die when moving the angle, or by providing a separate mechanism (e.g., separate hydraulic cylinders) to lift the punch die against the angle when punching is required, such lift methods have required separate items (hydraulic cylinders, rollers, tapered slide blocks, hydraulic valves, and the associated IO and timing) to make things work correctly.

The present invention is directed toward overcoming one or more of the problems set forth above.

SUMMARY OF THE INVENTION

The present invention provides a novel, improved pressing mechanism for controlling and driving a workpiece tool and associated support block (such as a die) to modify the workpiece (e.g., create a hole, stamp an indentation, cut or shear the workpiece), and is particularly advantageously suited to working on the legs of a structural angle. This is accomplished with a compact structure which may be easily operated and controlled with minimal addition of carts.

In one aspect of the present invention, a machine is provided for pressing a workpiece tool against a workpiece in the direction of a first axis. The machine includes an earth plate adapted to be selectively positioned at a fixed position relative to the workpiece when the tool is pressed toward the workpiece, top and bottom plates spaced apart a fixed distance in the direction of the first axis, and a support plate between the earth plate and the top plate and supported for movement relative to the earth plate in the direction of the first axis when the earth plate is positioned at the fixed position. The top and bottom plates are supported for movement relative to the earth plate in the direction of the first axis when the earth plate is positioned at the fixed position, with the top plate being adapted to mount a workpiece tool thereto. The support plate is adapted to mount a die block thereto. The support plate is biased away from the earth plate and toward the top plate in the direction of the first axis, where a first stop limits movement of the bottom plate toward the earth plate, and a second stop limits movement of the support plate away from the earth plate. A drive is adapted to selectively move the support plate and the bottom plate in the direction of the first axis relative to each other, whereby (1) when the drive moves the support plate and bottom plates toward each other, the bottom plate is first brought into engagement with the first stop and then the support plate is retracted from the second stop and moved toward the earth plate, and (2) when the drive moves the support plate and bottom plates away from each other, the support plate is first brought into engagement with the second stop and then the bottom plate is moved away from the earth plate to move the top plate toward the support plate.

In one form of this aspect of the present invention, the bottom plate, earth plate, support plate and top plate are all oriented substantially perpendicular to the first axis.

In another form of this aspect of the present invention, a support block on the support plate is adapted to cooperate with a workpiece tool mounted to the top plate to modify the workpiece when the tool and the support block are brought together. In a further form, the workpiece is modified by the addition of a hole therein, with the support block being adapted to substantially engage one side of the workpiece when the support plate engages the second stop, and the workpiece tool being a punch driven through the workpiece from the other side when the drive moves the support plate and bottom plate away from each other.

In still another form of this aspect of the present invention, the drive comprises a piston and cylinder extending between the support and bottom plates. In a further form, the piston is secured to the bottom plate and the cylinder is secured to the support plate whereby extending the cylinder drives the bottom and support plates apart. In a still further form, the cylinder and piston extend through an opening in the earth plate, the second stop comprises a first shoulder around the earth plate opening, and the cylinder has an outwardly extending second shoulder adapted to engage the earth plate first shoulder when the support plate is at a predetermined position. In a yet further form, the predetermined position is the position at which a die block on the support plate substantially engages one side of the workpiece.

In yet another form of this aspect of the present invention, the first axis is oriented perpendicular to the surface of the workpiece.

In still another form of this aspect of the present invention, a plurality of rods interconnect corners of the top and bottom plates, wherein the support and earth plates are slidably supported on the rods. In a further form, the biasing spring consists of compression springs on the rods between the earth and support plates.

In another form of this aspect of the present invention, the machine further includes a support frame having tracks arcuate about a second axis, rails supported on the arcuate tracks for selective rotation about the second axis, with the rails supporting the earth plate whereby when rotated the first axis remains substantially perpendicular to the second axis. In a further form, the earth plate is supported for selective linear motion along the rails in the direction of a third axis, the third axis being substantially perpendicular to both the first and second axes in all selected rotational positions of the rails.

In still further forms of this aspect of the present invention, the workpiece tool is a punch, or the workpiece tool is a plurality of punches supported on the top plate.

In another aspect of the present invention, a machine is provided for pressing a workpiece tool against a workpiece in the direction of a first axis. The machine includes (1) an earth plate oriented substantially perpendicular to the first axis and adapted to be selectively positioned at a fixed position relative to the structural angle when pressing the tool toward the workpiece, (2) a top plate oriented substantially parallel to the earth plate and adapted to mount a workpiece tool thereto, (3) a bottom plate oriented substantially parallel to the earth plate and spaced a fixed distance in the direction of the first axis from the top plate, the top and bottom plates supported for movement relative to the earth plate in the direction of the first axis, and (4) a support plate between the earth plate and the top plate and supported for movement relative to the earth plate in the direction of the first axis, the support plate being adapted to mount a die block thereto. The support plate is biased away from the earth plate and toward the top plate, with a first stop limiting movement of the bottom plate toward the earth plate and a second stop limiting movement of the support plate away from the earth plate. A drive is adapted to selectively move the support and bottom plates away from each other in the direction of the first axis.

In one form of this aspect of the present invention, the biasing force holds the bottom plate against the first stop until the drive moves the support plate into engagement with the second stop after which the bottom plate is driven away from the earth plate to move the top plate toward the support plate. In a further form, the support plate engages the second stop when a supported die is adjacent the structural angle.

In another form of this aspect of the present invention, the drive when operated in reverse moves the support plate and bottom plates toward each other whereby the bottom plate is first brought into engagement with the first stop after which the support plate is retracted from the second stop and moved toward the earth plate against the biasing spring.

In still another form of this aspect of the present invention, a die block on the support plate is adapted to cooperate with a workpiece tool mounted to the top plate to modify the workpiece when the tool and the die block are brought together.

In a further form, the workpiece is modified by the addition of a hole therein, the support block is a die adapted to substantially engage one side of the workpiece when the support plate engages the second stop, and the workpiece tool comprises a punch driven through the workpiece from the other side when the drive moves said support plate and bottom plate away from each other.

In yet another form of this aspect of the present invention, the machine also includes a support frame having tracks arcuate about a second axis, rails supported on the arcuate tracks for selective rotation about the second axis, with the rails supporting the earth plate whereby when rotated the first axis remains substantially perpendicular to the second axis, and in the selected fixed positions of the earth plate, the first axis is substantially perpendicular to the surface of the workpiece toward which the tool is biased. In a further form, the earth plate is supported for selective linear motion along the rails in the direction of a third axis, with the third axis being substantially perpendicular to both the first and second axes in all selected rotational positions of the rails.

In still another form of this aspect of the present invention, the drive consists of a piston and cylinder extending between the support and bottom plates. In a further form, the piston is secured to the bottom plate and the cylinder is secured to the support plate whereby extending the cylinder drives the bottom and support plates apart. In a still further form, the cylinder and piston extend through an opening in the earth plate, the second stop is a first shoulder around the earth plate opening, and the cylinder has an outwardly extending second shoulder adapted to engage the earth plate first shoulder when the support plate is at a predetermined position. In a yet further form, the predetermined position is the position at which a support block on the support plate substantially engages one side of the structural angle.

In another form of this aspect of the present invention, a plurality of rods interconnect corners of the top and bottom plates, wherein the support and earth plates are slidably supported on the rods. In a further form, the biasing spring consists of compression springs on the rods between the earth and support plates.

BRIEF DESCRIPTION OF THE DRAWINGS

FIGS. 13*a*-13*e* are orthogonal views of the FIG. 10 pressing mechanism, wherein FIG. 13*a* is a top view, FIG. 13*b* is a left view, FIG. 13*c* is a front view, FIG. 13*d* is a right view, and FIG. 13*e* is a bottom view;

DETAILED DESCRIPTION OF THE INVENTION

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

For ease of description, the apparatus operating in accordance with this invention is described in the normal (upright) operating position, and terms such as upper, lower, horizontal, etc., are used with reference to this position.

The apparatus of this invention can have certain conventional components and control mechanisms the details of which, although not fully illustrated or described, will be apparent to those having skill in the art and an understanding of the necessary functions of such components and mechanisms.

Some of the Figures illustrating the preferred embodiment of the apparatus of the present invention show conventional structural details and mechanical elements or components that will be recognized by one skilled in the art. However, the detailed descriptions of such elements are not necessary to an understanding of the invention, and accordingly, are herein presented only to the degree necessary to facilitate an understanding of the novel features of the present invention.

Figure 1:
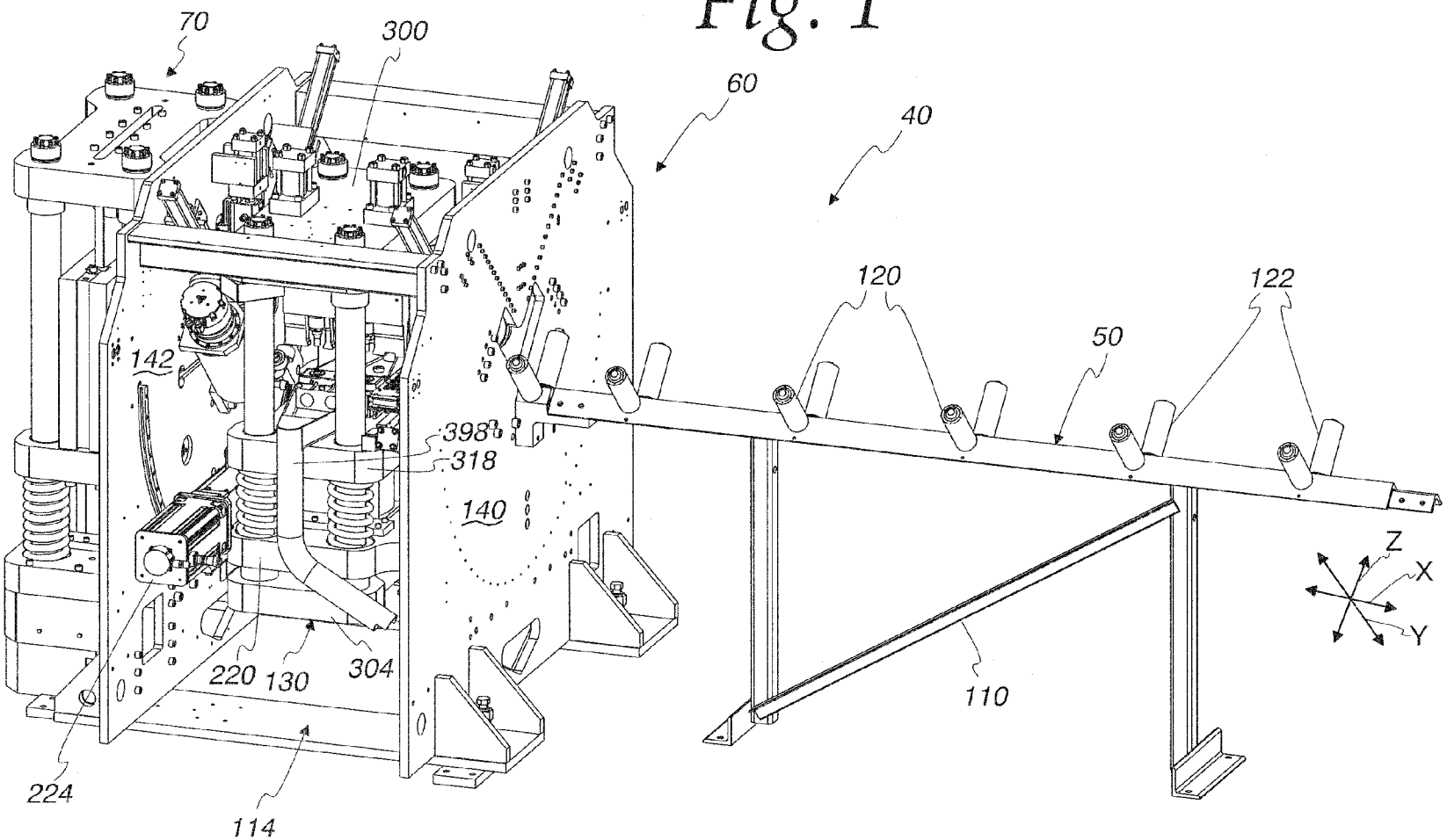
FIG. 1 is an isometric view of a structural angle processing system incorporating the present invention, including (1) a workpiece gripping and advancing module or machine, (2) a punch press module or machine, and (3) a shear module.

FIG. 1 illustrates an embodiment of a processing system 40 in which the present invention is incorporated. For ease of illustration, some of the conventional system components (e.g., hydraulic lines, electrical power conduit, etc.) have been omitted. The system includes a processing path along which a length of a workpiece 44, such as an angle iron or structural steel angle (see FIGS. 14*b*, 15*b* and 16*b*), can be moved and positioned, with the workpiece being modified along that path. Such modifications of the workpiece can include, for example, punching or drilling holes in the workpiece, stamping markings such as characters in the workpiece, and cutting or shearing the workpiece, either to create a cut or to completely cut off a shorter piece, all of which are considered "modifying the workpiece" as used herein.

The processing system 40 may be regarded as a single, processing system, line, or combination machine which includes three individual modules, assemblies, or machines: (1) a workpiece gripping and advancing module 50, (2) a punch press module or machine 60, and (3) a workpiece shear module 70. In the preferred arrangement illustrated, the three modules are bolted together and can be operated together as a system.

The illustrated punch press module or machine 60 incorporates the present invention for pressing workpiece or cutting tools toward and against the workpiece (e.g., to press a punch into and through a workpiece). While the workpiece 44 as illustrated and discussed herein in connection with the illustrated embodiment is an angle iron or structural angle 44 (see FIGS. 14*b*, 15*b*, 16*b*), it should be appreciated that the present invention could be used with still other workpieces, including flat stock, bar stock, and channel shapes.

Further, it should be appreciated that the punch press as illustrated for module 60 could incorporate other workpiece or cutting tools (e.g., tool(s) which are operated by pressing the tool against the workpiece to cut or modify the workpiece in some manner), such as a drill and/or character stamps in addition to, or instead of, a punch. Moreover, such workpiece tools could also include a shear blade, in which case the present invention could also be incorporated in the workpiece shear module 70. For simplicity and clarity, however, the present invention is described here only in connection with the press module 60.

The workpiece gripping and advancing module 50 and the workpiece shear module 70 may be regarded as modules, assemblies, or machines which can be used in other applications as well as with the punch press module 60 of the present invention. The workpiece gripping and advancing module 50 and the workpiece shear module 70 may be of any suitable conventional or special design, the details of which form no part of the present invention. Indeed, a broad aspect of the present invention does not require that the punch press module 60 be used with either the workpiece gripping and advancing module 50 or the shear module 70.

The punch press module 60 is adapted to receive and process the stock length of structural angle 44, or even a much shorter, already cut-to-length section of angle 44. The module 60 is adapted to receive the length of angle 44 (or other shorter or longer piece of a structural angle) in a particular orientation that may be arbitrarily described as extending along an X-axis of a mutually orthogonal X, Y, and Z-axis coordinate system. FIG. 1 illustrates the orientation of the Y-axis and Z-axis of the coordinate system, and the Y-axis and Z-axis together define a plane perpendicular to the length of the angle 44 which is oriented lengthwise along or parallel to the X-axis.

As used herein, components which are described as being moved or oriented "along" the X, Y, or Z-axis or moved to a location along or on the X, Y, or Z-axis should be understood to be moved or oriented on a path that is spaced from, but parallel to, the particular designated axis that passes through the coordinate system origin. Further, it should be understood that references to movement in the X, Y, or Z-axis "direction" may refer to either of the two opposite directions along the particular designated axis.

Figure 2:
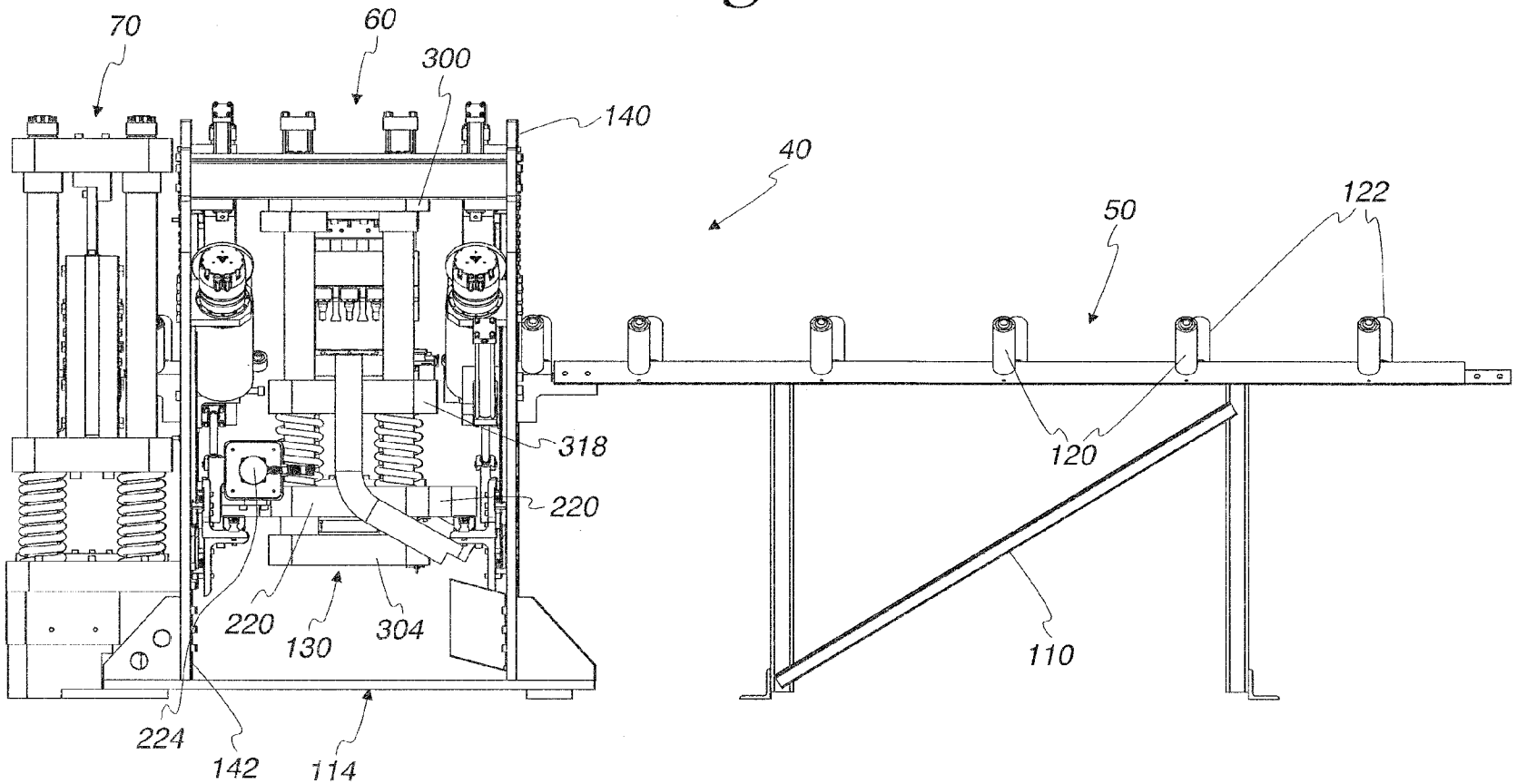
FIG. 2 is a front view of the FIG. 1 processing system.

In the preferred form of the processing system 40 illustrated in FIGS. 1-2, the angle 44 is supported and processed at a convenient height above the floor, and to this end, the workpiece gripping and advancing module 50 includes a suitable support frame 110 which may have any suitable conventional or special construction (the details of which form no part of the present invention), and the punch press module 60 includes a support frame 114.

Figure 14A:
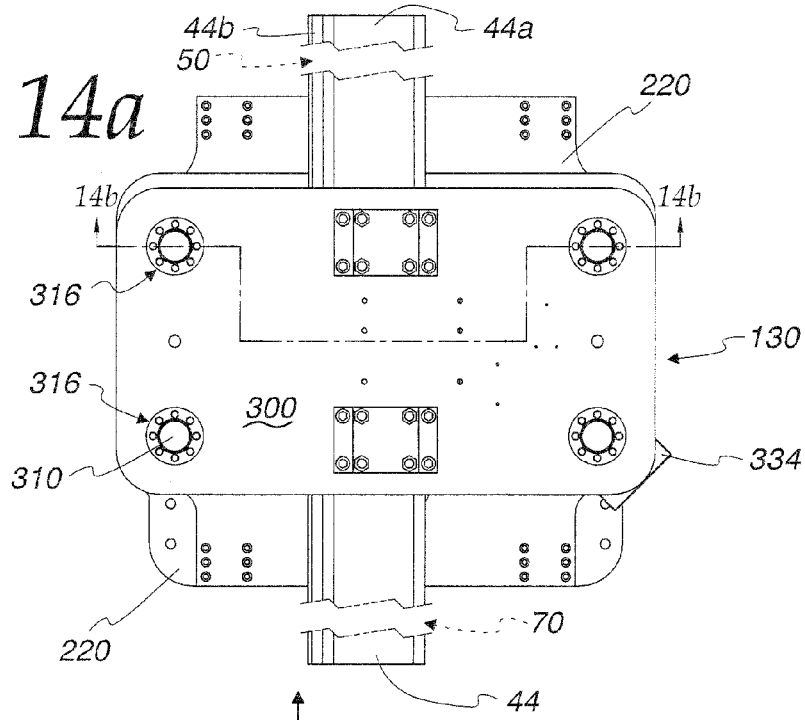
FIG. 14*a* is a top view of the pressing mechanism of FIG. 10.
Figure 14B:
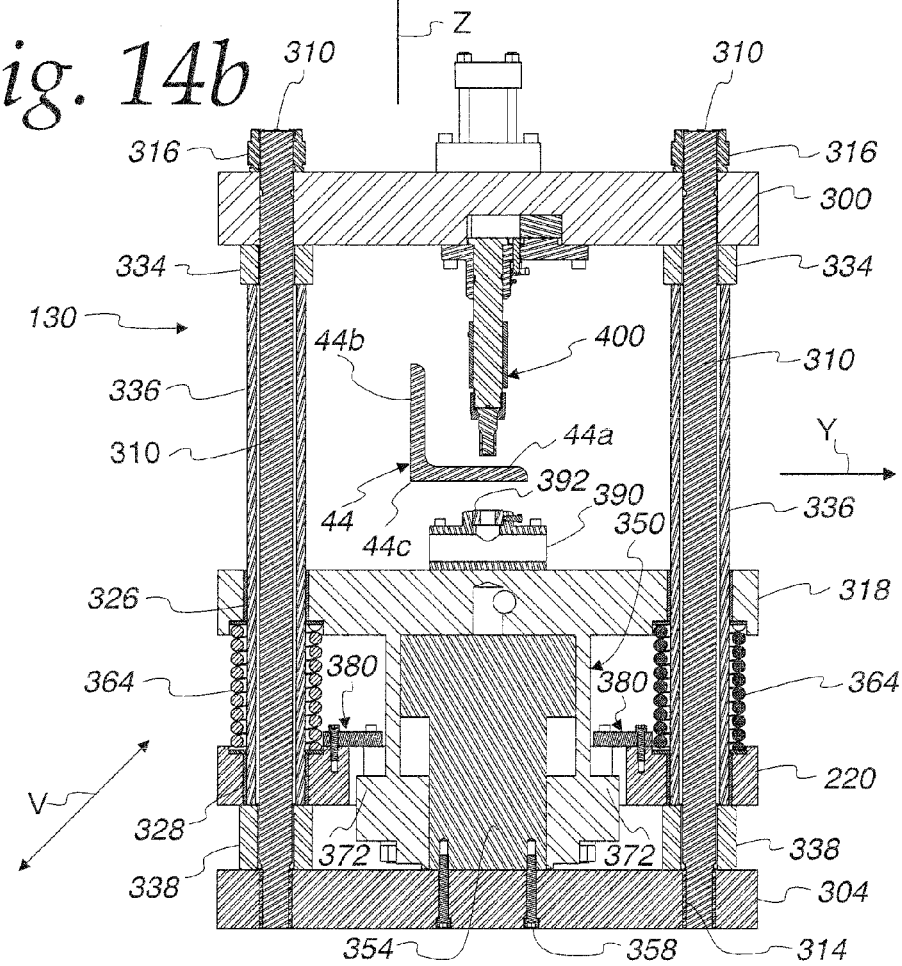
FIG. 14*b* is a cross-sectional view taken along line 14*b*-14*b* of FIG. 14*a*, showing the pressing mechanism in a neutral, non-pressing position.
Figure 15A:
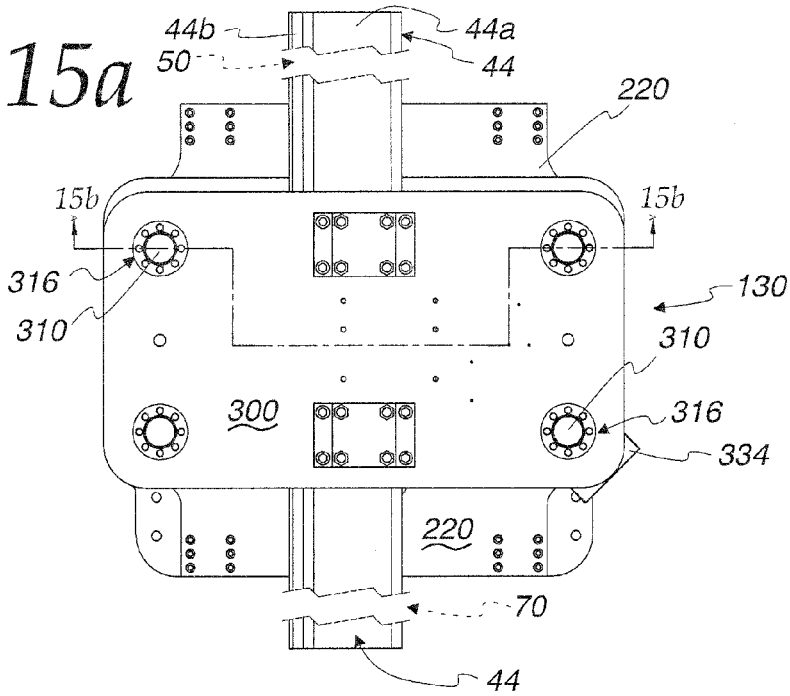
FIG. 15*a* is a top view of the pressing mechanism of FIG. 10.
Figure 15B:
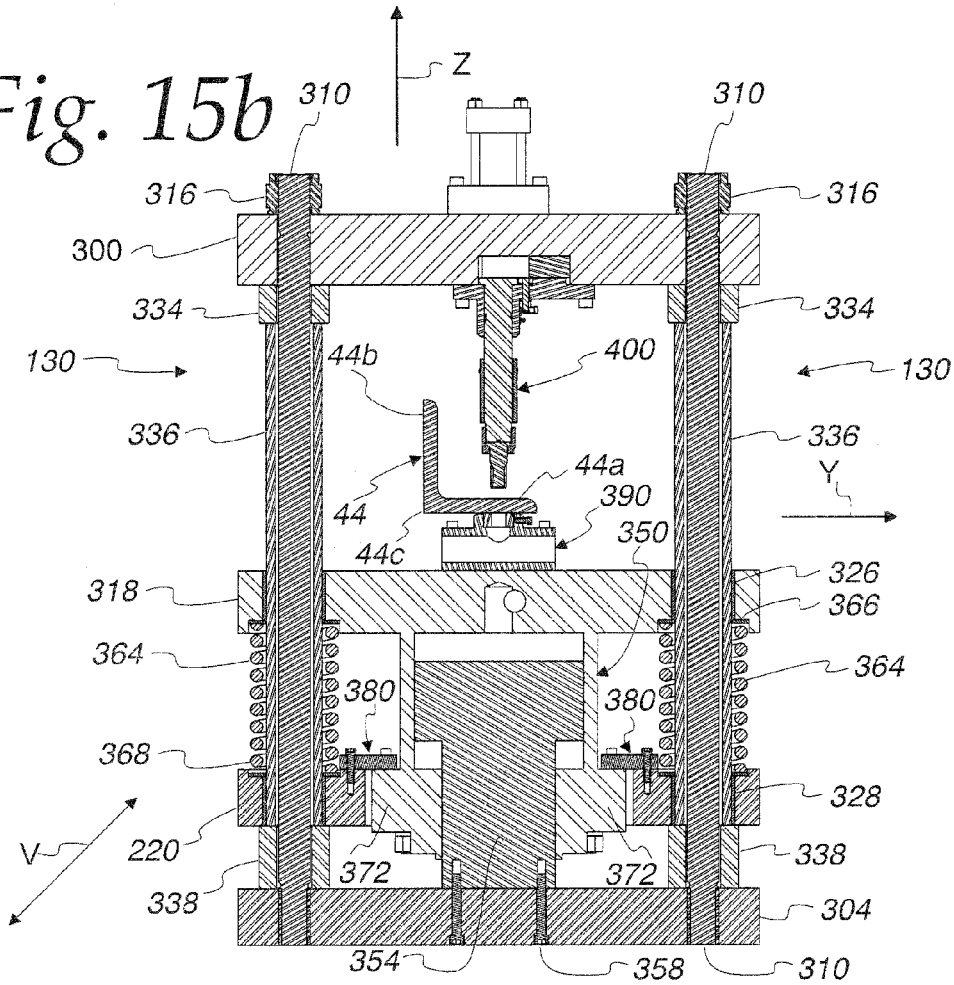
FIG. 15*b* is a cross-sectional view taken along line 15*b*-15*b* of FIG. 15*a*, showing the pressing mechanism in an intermediate position between a neutral and pressing position.
Figure 16A:
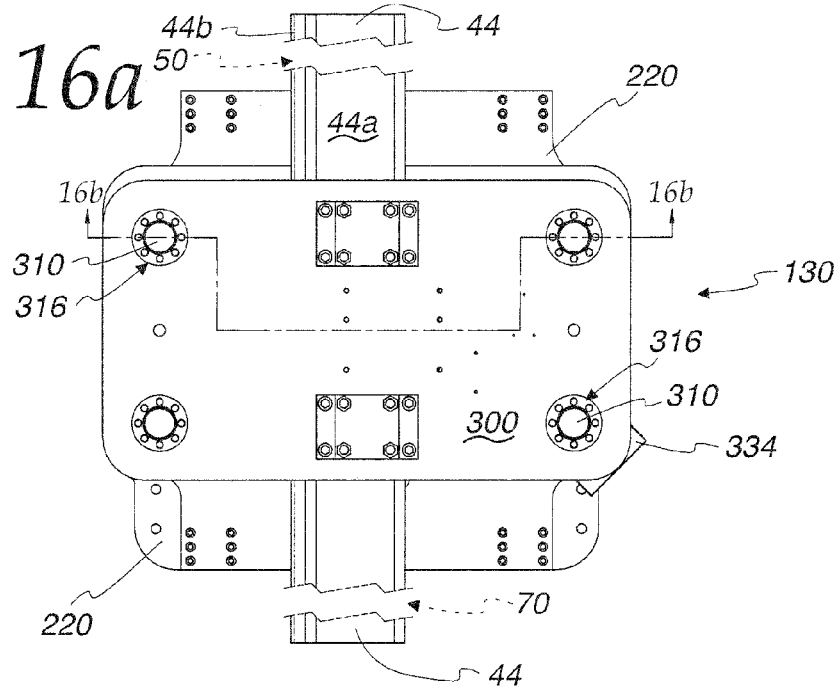
FIG. 16*a* is a top view of the pressing mechanism of FIG. 10.
Figure 16B:
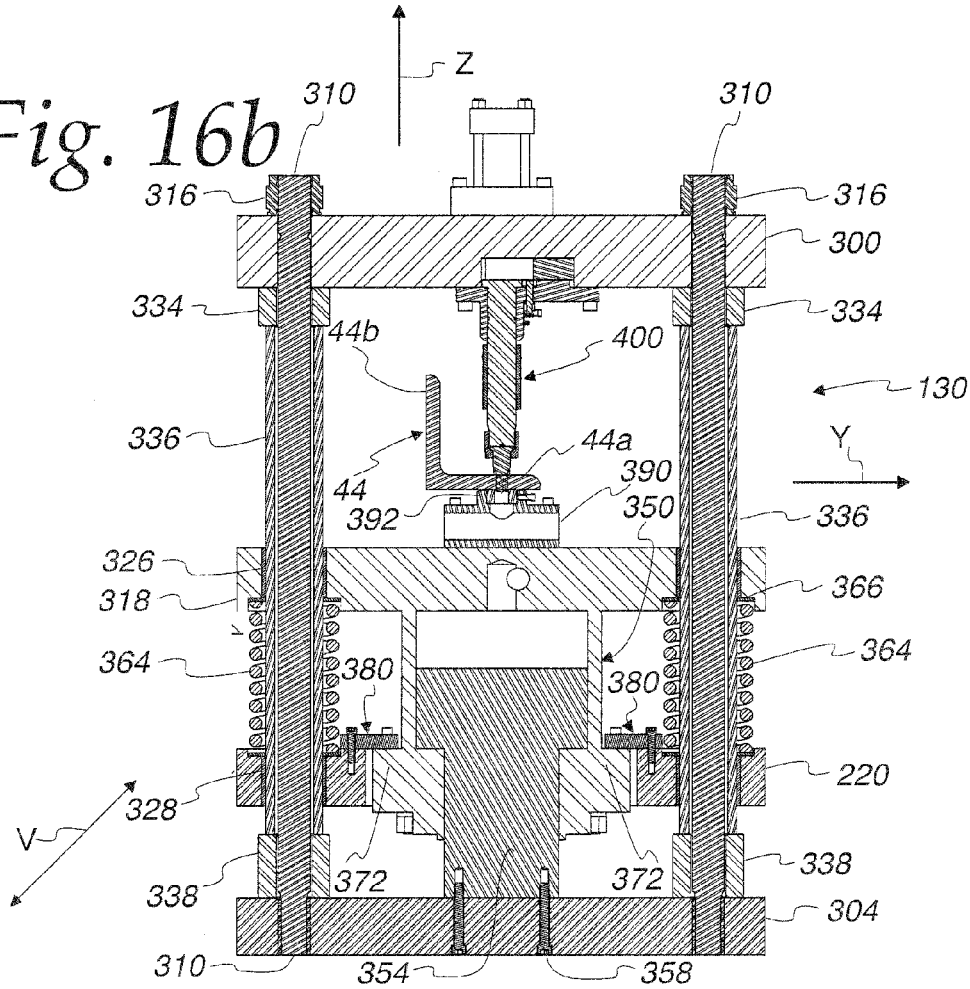
FIG. 16*b* is a cross-sectional view taken along line 16*b*-16*b* of FIG. 16*a*, showing the pressing mechanism in the pressing position.

The angle 44 has a first leg 44*a* and a second leg 44*b* which diverge from a vertex or bend or heel 44*c* (e.g., FIG. 14*b*). Recognizing that the punch press module 60 in FIGS. 14*b*, 15*b*, 16*b* is pivoted relative to horizontal (with vertical being in the V-direction [see FIG. 14*b*]), the angle 44 is oriented so that the heel 44*c* projects downwardly while the legs 44*a* and 44*b* extend upwardly. For a conventional angle 44 which is typically employed in a variety of uses, the first leg 44*a* and second leg 44*b* define a right angle (i.e., the first leg 44*a* and second leg 44*b* diverge from the heel 44*c* to define a 90 degree included angle). The first leg 44*a* is supported on rollers 120 (FIGS. 1-2) which are part of the workpiece gripping and advancing module 50, and the second leg 44*b* is supported on a plurality of rollers 122 which are also part of the workpiece gripping and advancing module 50.

As best illustrated in FIGS. 14*b*, 15*b*, 16*b*, the first leg 44*a* projects from the heel 44*c* in the direction of the Y-axis, with the heel 44*c* extending along the X-axis, whereby the face of the first leg 44*a* lies in a plane which includes lines parallel to the X and Y-axes and is perpendicular to the Z-axis. The second leg 44*b* projects from the heel 44*c* in the direction of the Z-axis, whereby the face of the second leg 44*b* lies in a plane which includes lines parallel to the X and Z-axes and is perpendicular to the Y-axis.

Although the workpiece gripping and advancing module 50 forms no part of the present invention, it should be appreciated that the module 50 advantageously allows the angle 44 to be moved along the X-axis through the punch press module 60 and through the workpiece shear module 70. The workpiece gripping and advancing module 50 as described are particularly advantageous when the present invention is used with an angle 44 as a workpiece, though it should be understood that still other supports for the workpiece could be used (including the support illustrated in U.S. Pat. No. 7,418,773, the full disclosure of which is hereby incorporated by reference), including supports for workpieces which are not angles 44.

A suitable carriage or gripper assembly may be used to control movement of the angle 44 along the gripping and advancing module 50. For example, a frictionally-engaging drive wheel 124 (see FIG. 3) may be provided, where the wheel 124 may be biased against the angle 44 whereby turning of the wheel 124 will frictionally advance the angle 44 along the X-axis. It should be understood, however, that the details of a carriage or gripper assembly are unimportant to the present invention except to the extent that they will adequately advance the angle. Indeed, the punch press module 60 may be advantageously used without any automatic workpiece gripping and advancing module 50 if the angle 44 is manually moved into, through, and out of the punch press module 60. However, of course, the processing of a structural angle 44 is more efficient and less labor intensive if some sort of workpiece gripping and advancing mechanism, such as the module 50, is employed to feed the angle 44 through the punch press module 60.

The angle 44 is fed into the punch press module 60, where it may be punched and/or drilled according to the requirements of the intended use of the angle 44. As described in greater detail hereafter, the module 60 includes a pressing mechanism 130 (see particularly FIGS. 10-16*b*) which is supported for rotary movement around the X-axis as well as also being selectively movable in any rotary position in a linear direction perpendicular to the X-axis (and particularly movable in a plane containing the Y and Z-axes depending on the rotary position of the pressing mechanism 130).

FIGS. 3-9 illustrate one sample structure which may advantageously be used to support the pressing mechanism 130 for rotary and linear movement.

In the illustrated structure (see particularly FIG. 9), rails 134 on opposite sides of the pressing mechanism 130 are each suitably supported at least at two locations for rotary movement around the X-axis along arcuate tracks 136 suitably secured, as by rivets or screws 138, to respective side plates 140, 142 (one side plate 140 being an entry side plate and the other being an exit side plate 142). In the advantageous embodiment illustrated, the side plates 140, 142 are spaced apart, are parallel to each other, and are each perpendicular to the X-axis. The entry side plate 140 includes an opening or aperture 144 (see, e.g., FIG. 3), and the exit side plate 142 includes a similar opening or aperture, the openings accommodating passage and positioning of the structural angle 44 into and through the punch press module 60.

A pair of guides 150 are suitably secured to each of the rails 134 (e.g., by rivets or screws 152), and third guides 150 are secured (e.g., by rivets or screws 156) to the outwardly extending flanges 158 of angle brackets 160 which are secured to the (radially) outer side of the rails 134 (e.g., by rivets or screws 162).

The three guides 150 associated with each of the rails 134 are oriented to follow the associated arcuate tracks 136. For example, by evenly spacing the guides 150, the rail 134 will move in an arcuate path whereby the spacing of the rail 134 from the arcuate center of the tracks 136 (i.e., the X-axis) will remain constant.

A position control cylinder 170 is pivotally secured to the side plate 140. For example, in the illustrated embodiment, a pair of clamps 174 are secured to the side plate 140 (e.g., by rivets or screws 176) to define a yoke having aligned pivot holes 180 receiving pivot pins 182 on the cylinder 170.

The end of the piston rod 190 of the cylinder 170 is secured to a connector 194 which is itself pivotally connected to a plate flange 196 suitably connected to the rail 134 (e.g., by rivets or screws 198).

Figure 9:
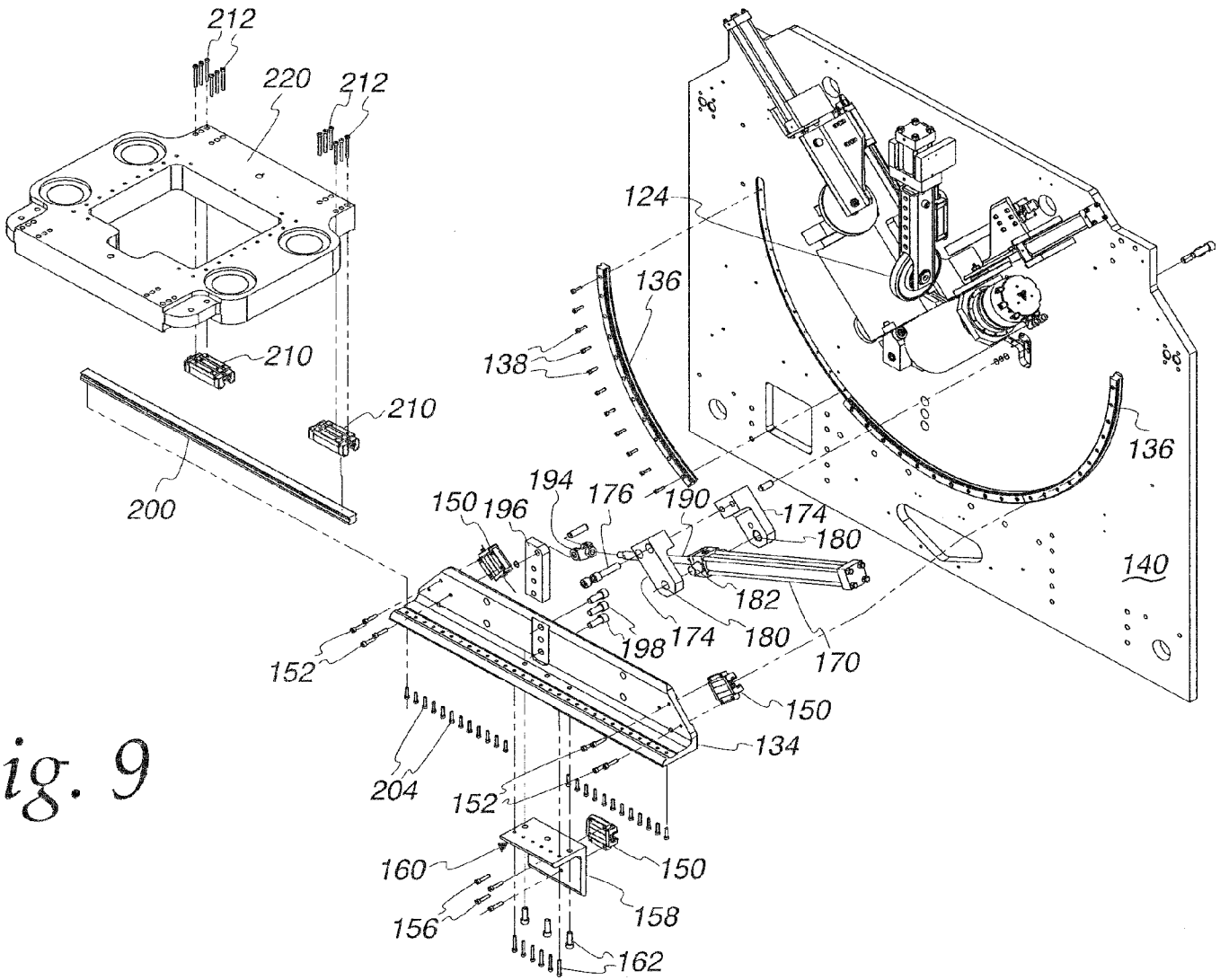
FIG. 9 is an exploded isometric view of the FIG. 3 structure with tracks and guides supporting a support rail and the earth plate of a supported pressing mechanism.
Figure 10:
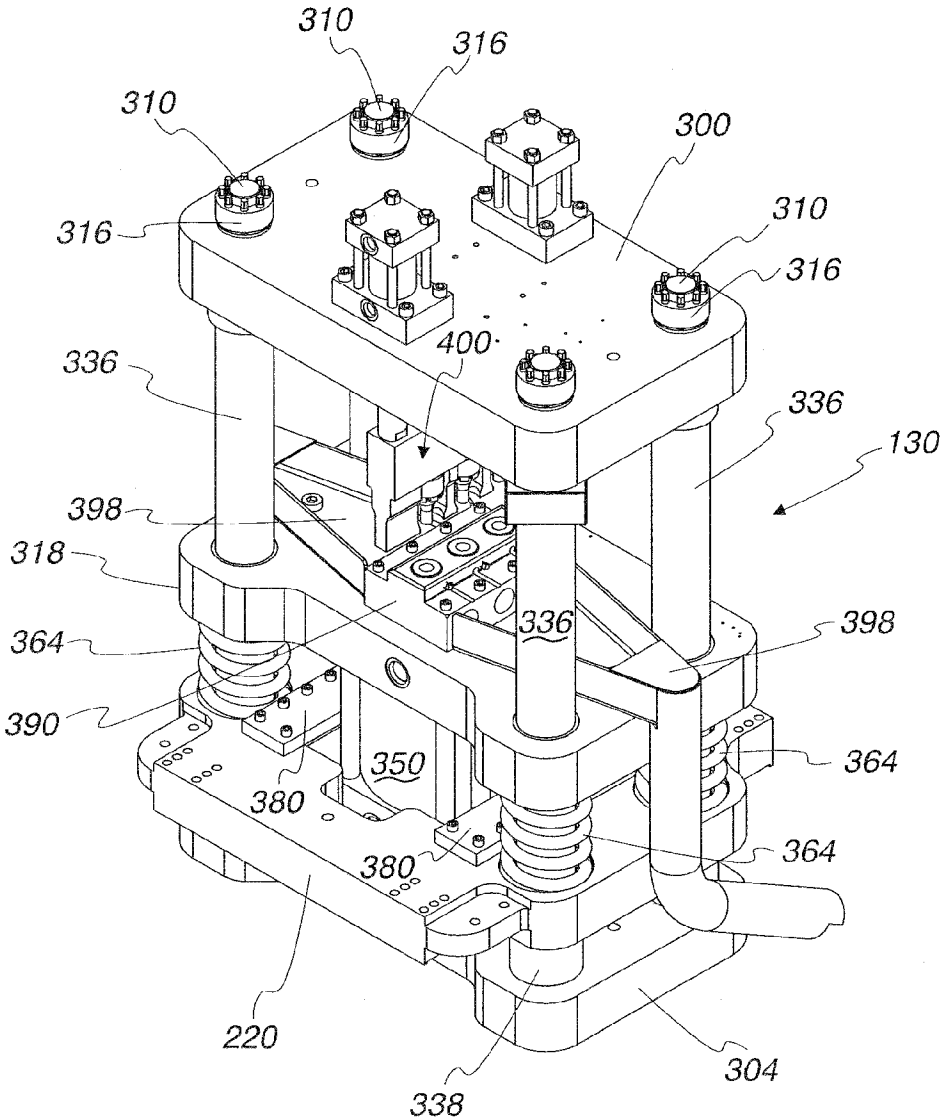
FIG. 10 is an isometric view of a supported pressing mechanism supported by the FIG. 9 structure.
Figure 11:
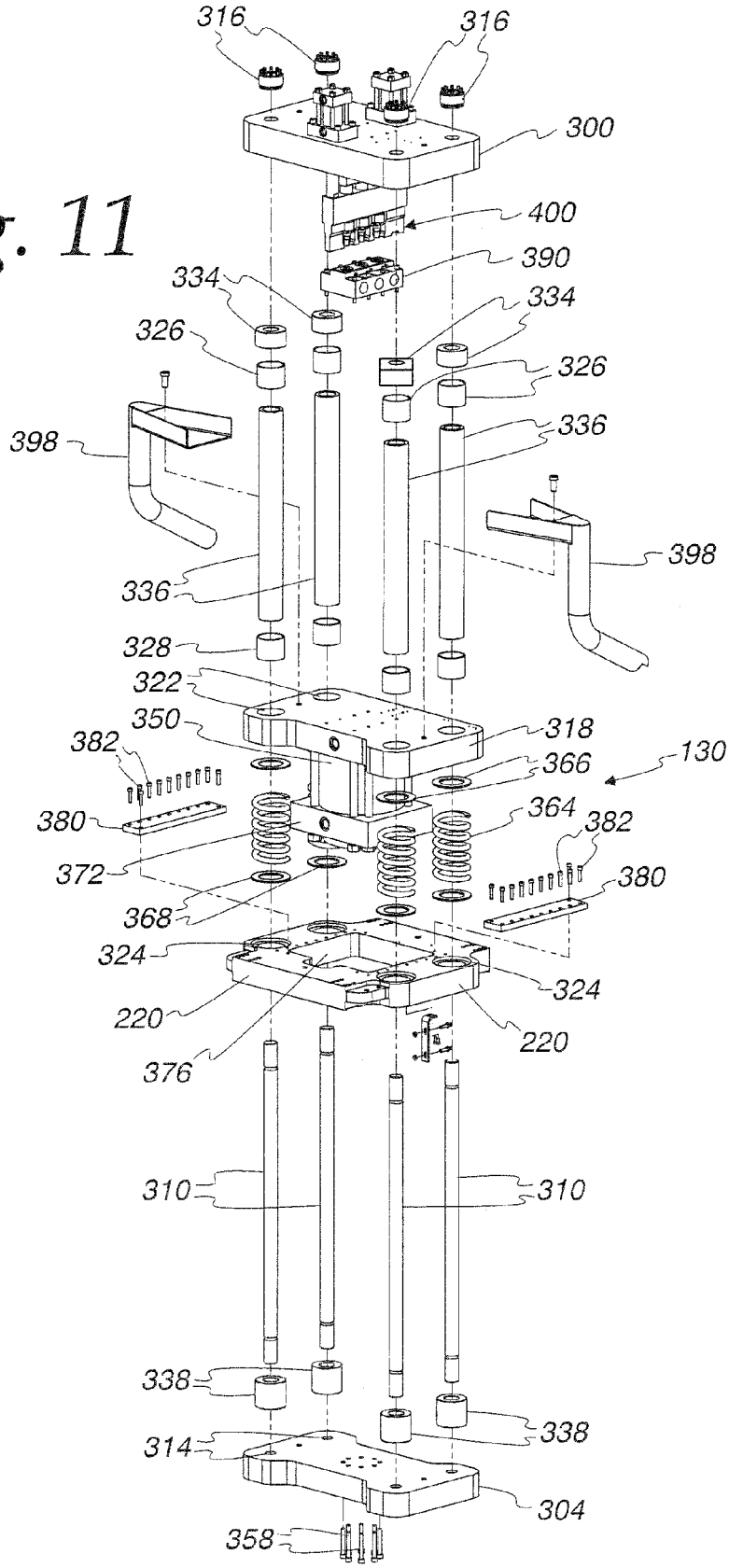
FIG. 11 is an exploded isometric view of the pressing mechanism of FIG. 10.

Linear tracks 200 are suitably secured (e.g., by rivets or screws 204) to each rail 134, and guides 210 are suitably secured (e.g., by rivets or screws 212) to the earth plate 220 of the pressing mechanism 130 (only the earth plate 220 is illustrated in FIG. 9), whereby the earth plate 220 may be controllably moved linearly along the rails 134, as well as pivoting with the rails 134 around the tracks 136. A suitable drive, such as a servo motor 224 (see FIGS. 1-2) driving a ball screw may be secured to the earth plate 220 and to one of the rails 134 (e.g., to plate flange 196), to control linear movement of the earth plate 220 along the linear tracks 200 along the rails 134.

It should be appreciated that suitable bearings may be provided between the tracks 136, 200 and guides 150, 210 to facilitate relative movement. Further, it should be understood that the tracks 136, 200 and guides 150, 210 are provided on both sides of the press and drill module 60 (e.g., associated with both side plates 140, 142), whereas a position control cylinder 170 may be provided on only one side of the press and drill module 60 (e.g., connected to entry side plate 140), or a similar structure may be provided on both sides of the press and drill module 60 (e.g., connected to both side plates 140, 142), in order to control the position of the pressing mechanism 130 as illustrated in FIGS. 3-8 and as described in further detail below.

Thus, it should be appreciated that the pressing mechanism 130 can be both rotated around the X-axis and also moved linearly in the plane of the Y and Z axes, with its earth plate 220 of the pressing mechanism 130 fixed in any given position relative to an angle 44 extending through the mechanism 130. Further, it should be appreciated that while the position control cylinder 170 and servo motor driven ball screw 224 may be advantageously used as illustrated, virtually any drive capable of moving the rails 134 and/or the earth plate 220 relative to the tracks 136, 200 to secured them in desired positions could be used within the broadest scope of the present invention. Such operation advantageously allows not only any drill and/or punch associated with the pressing mechanism 130 to be oriented and positioned as desired relative to the angle 44, but the described movement may also allow still other pressing tools (e.g., adjustable stamps which may also be carried and operated by the pressing mechanism 130) to be similarly oriented and positioned as desired relative to the angle 44. For example, the adjustable character stamp structure disclosed in my own application (filed concurrently herewith on Oct. 30, 2009 as Ser. No. 12/609,551, titled "Adjustable Character Stamp", the disclosure of which is hereby fully incorporated by reference) could be mounted on the support plate 318 of the pressing mechanism 300 disclosed herein.

Figure 3:
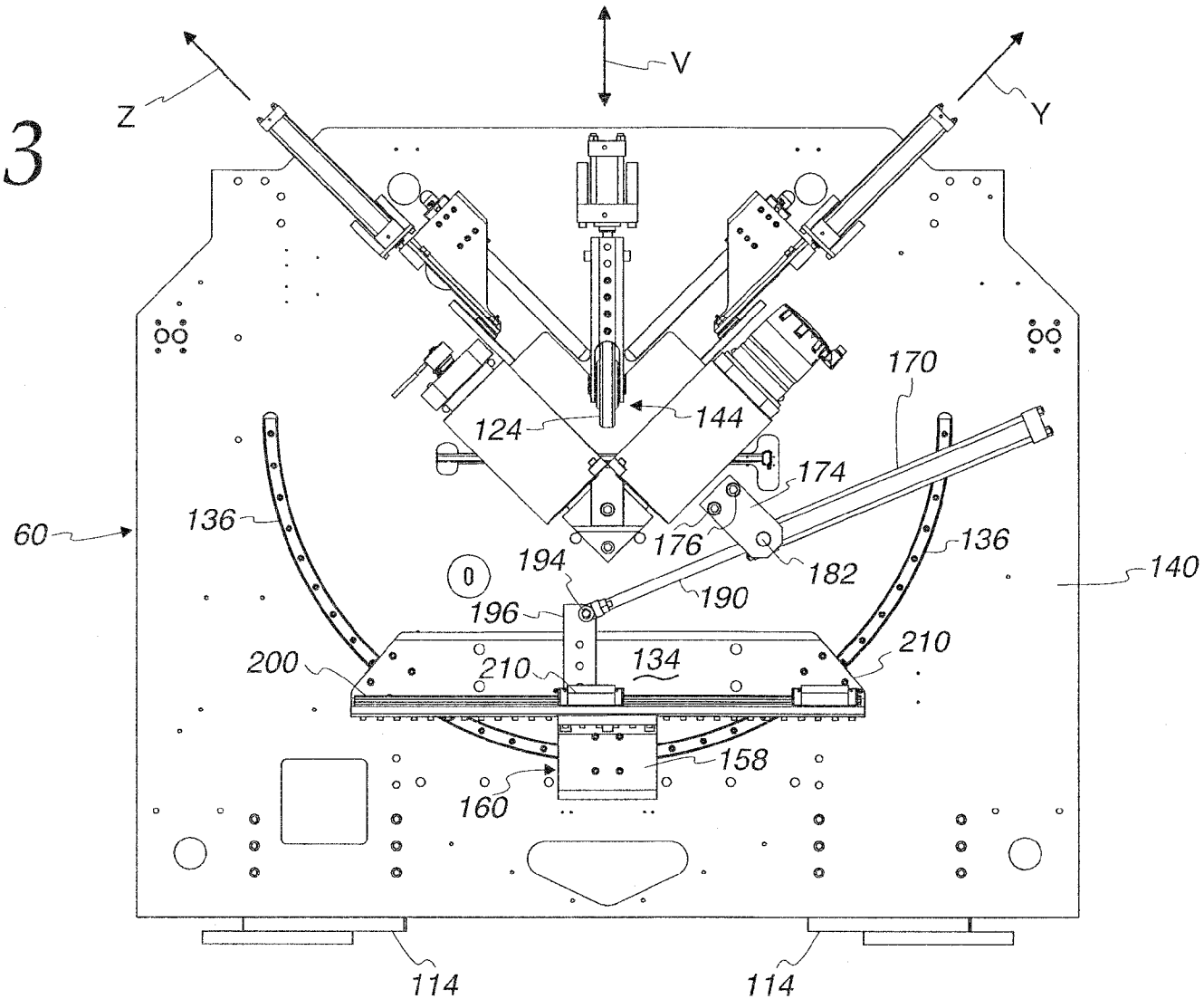
FIG. 3 is a cut-away side view of a side plate of the punch press module of FIG. 1, illustrating the tracks and guides supporting a support rail in a first position.
Figure 4:
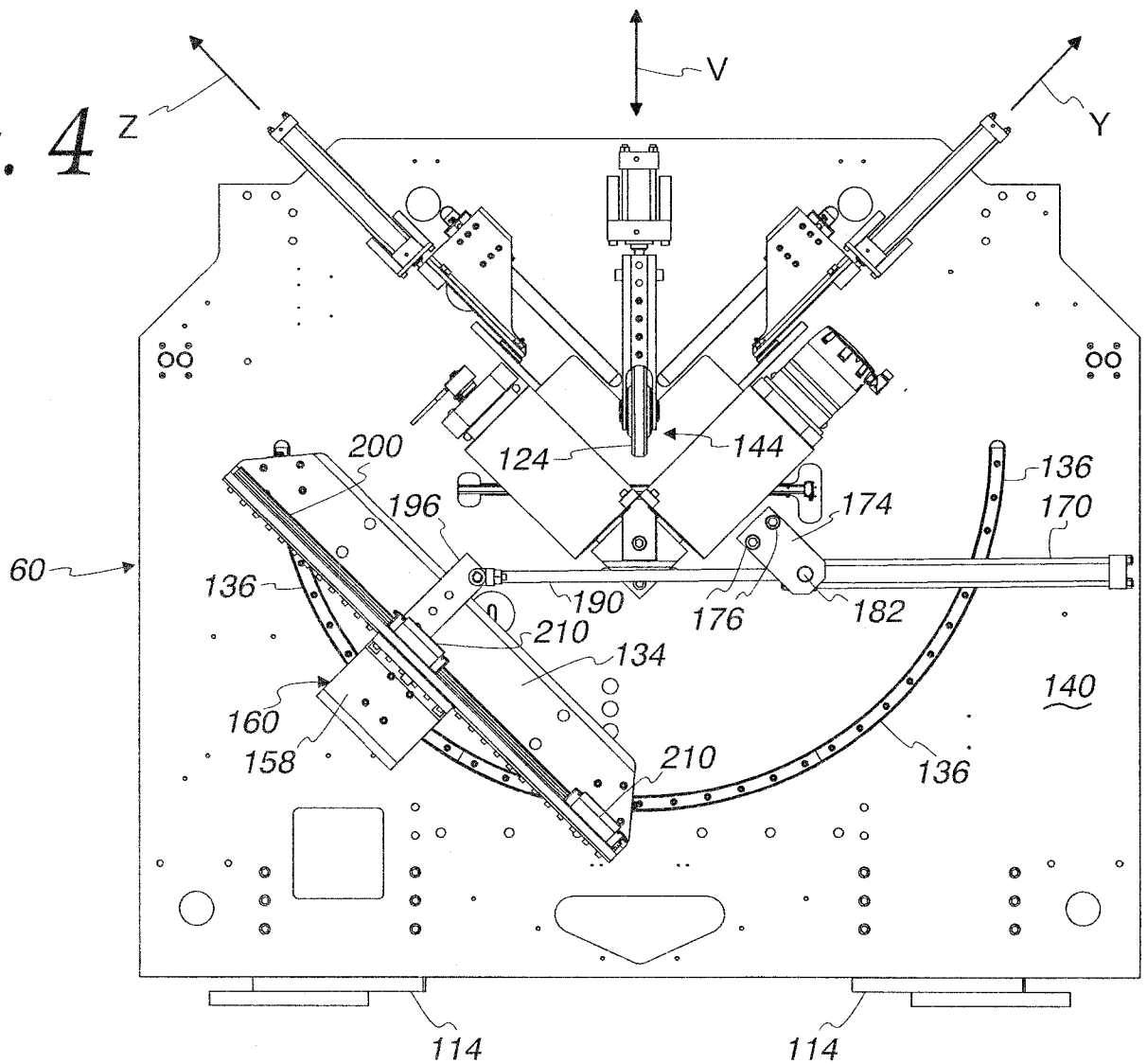
FIG. 4 is a cut-away side view similar to FIG. 3, illustrating the tracks and guides supporting a support rail in a second position.
Figure 5:
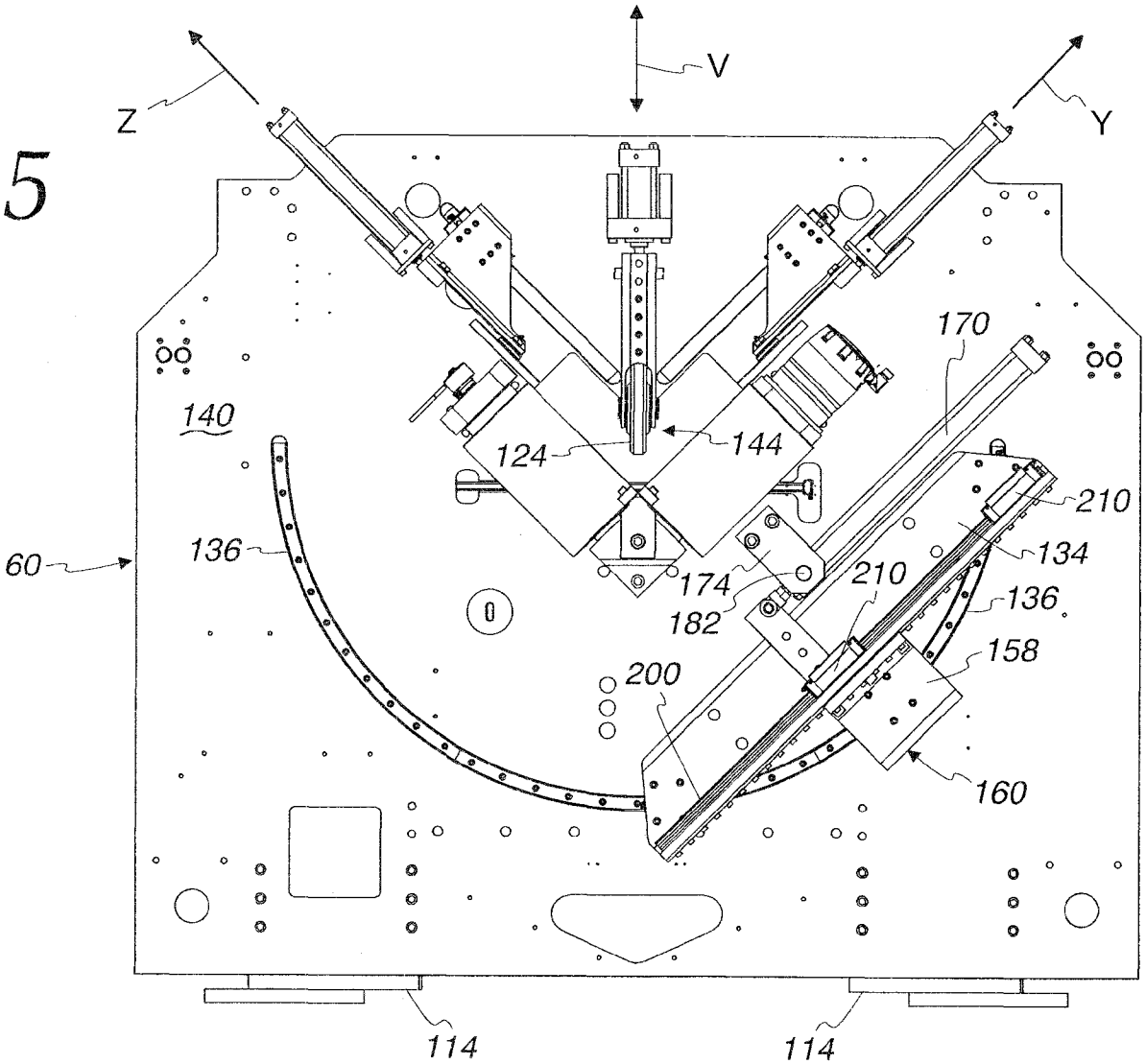
FIG. 5 is a cut-away side view similar to FIG. 3, illustrating the tracks and guides supporting a support rail in a third position.
Figure 6:
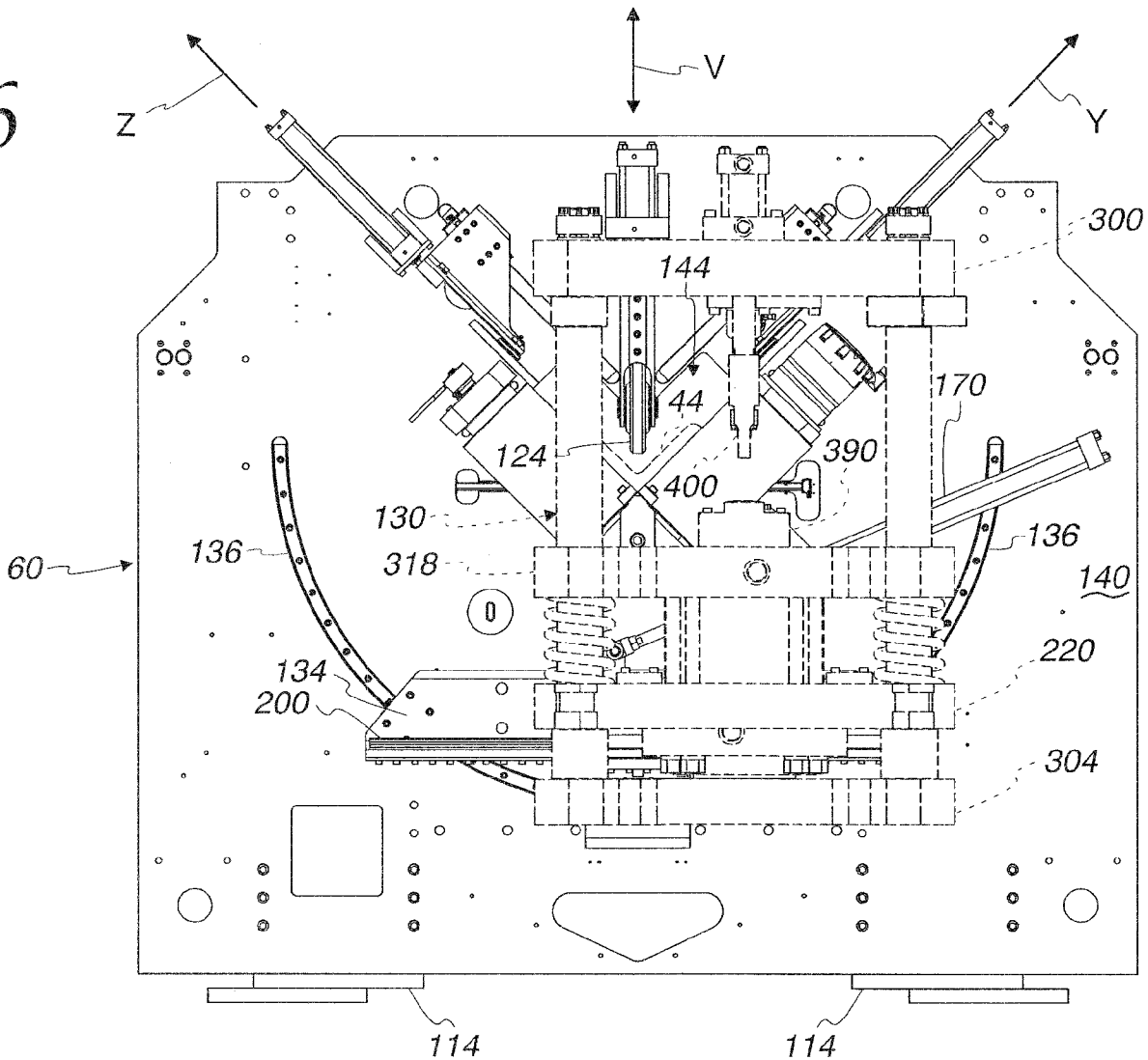
FIG. 6 is a view corresponding to FIG. 3, with a workpiece and supported pressing mechanism illustrated in phantom.
Figure 7:
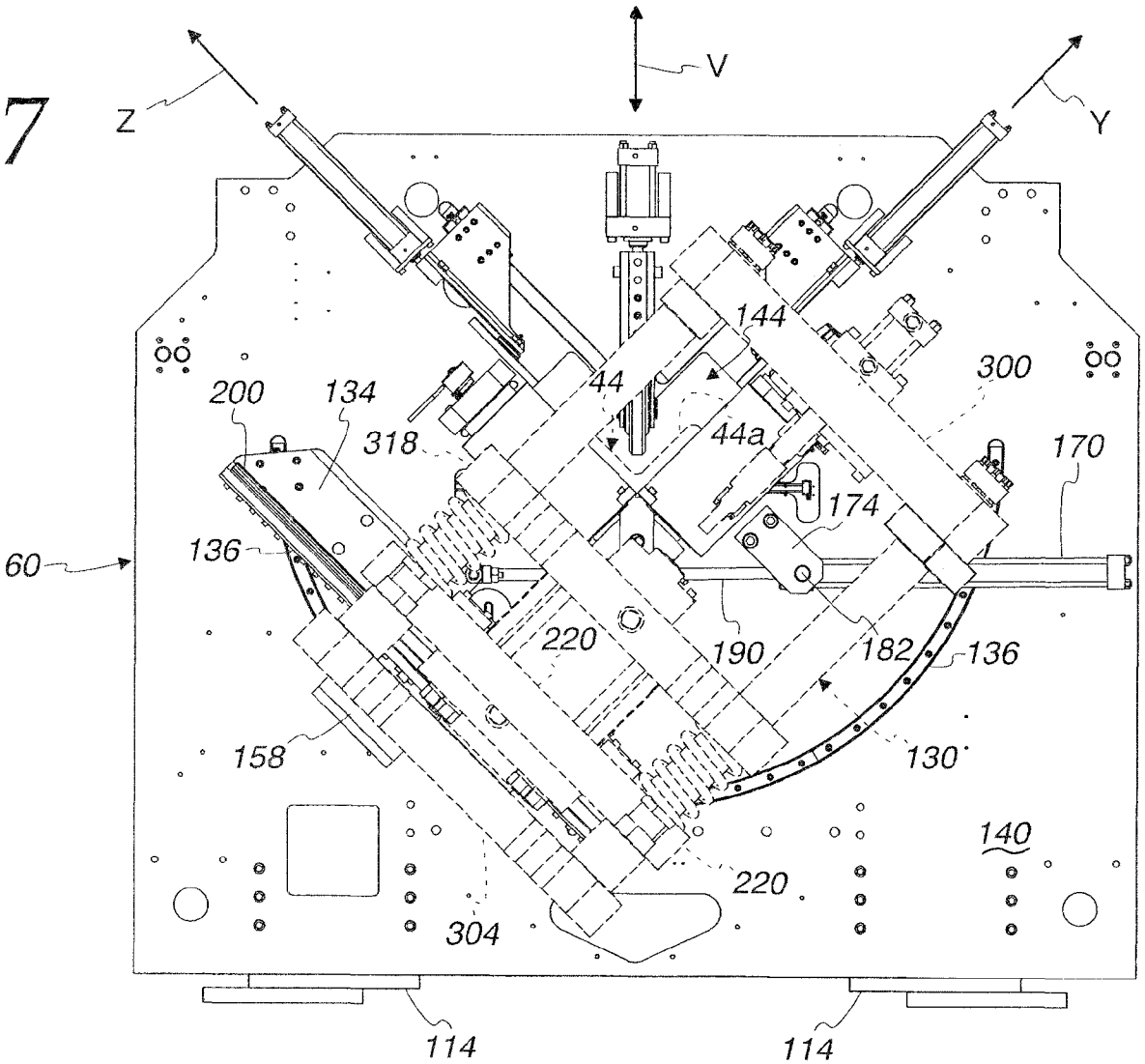
FIG. 7 is a view corresponding to FIG. 4, with a workpiece and supported pressing mechanism illustrated in phantom.
Figure 8:
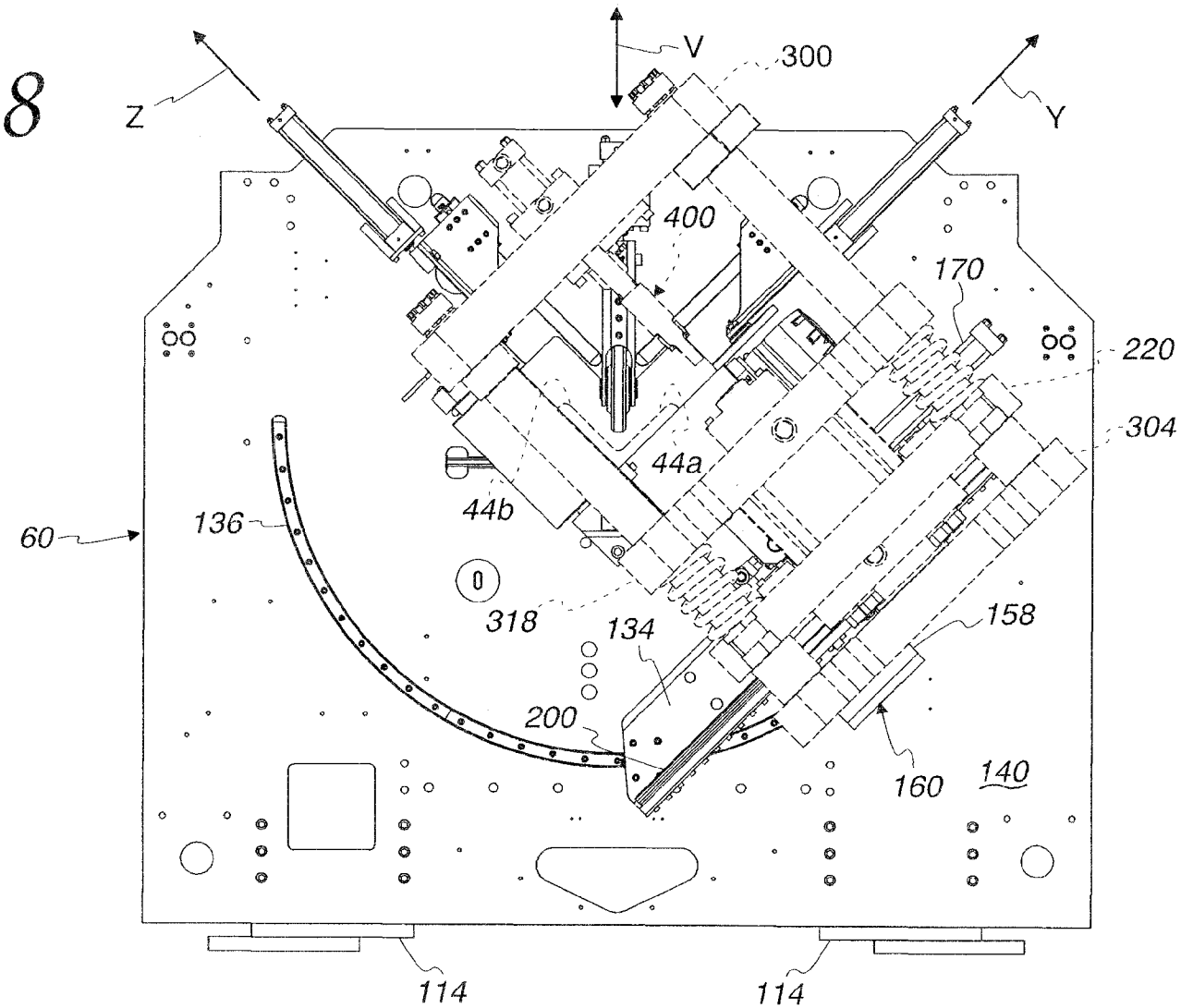
FIG. 8 is a view corresponding to FIG. 5, with a workpiece and supported pressing mechanism illustrated in phantom.

It should also be appreciated that the tracks 136, 200 and guides 150, 210 are provided on both sides of the press and drill module 60 (e.g., associated with both side plates 140, 142), whereas a position control cylinder 170 may be provided on only one side of the press and drill module 60 (e.g., connected to entry side plate 140), or a similar structure may be provided on both sides of the press and drill module 60 (e.g., connected to both side plates 140, 142), in order to control the position of the pressing mechanism 130 as illustrated in FIGS. 3-8 and as described in further detail below. Specifically:

(a) The pressing mechanism 130 may be rotationally positioned (by the position control cylinder 170) around the X-axis to properly orient the earth plate 220 relative to the leg of the angle 44 through which it is desired to punch or drill a hole, and/or on which it is desired to stamp a character of an adjustable stamp carried by the pressing mechanism 130. For example, as illustrated in FIGS. 3 and 6, the rail 134 is oriented horizontally with the earth plate 220 of the pressing mechanism 130 thereby also oriented horizontally (it should be appreciated that in this position, an operator may most easily gain access to the punch and/or die to make any changes and or adjustments). By extending the piston rod 190 of the position control cylinder 170, the rail 134 (and carried earth plate 220) may be pivoted 45 degrees so that the earth plate 220 is substantially parallel to the Z-axis and perpendicular to the Y-axis, as shown in FIGS. 4 and 7. Similarly, by retracting the piston rod 190 of the position control cylinder 170, the rail 134 (and carried earth plate 220) may be pivoted 45 degrees to the other side of the horizontal position so that the earth plate 220 is substantially parallel to the Y-axis and perpendicular to the Z-axis, as shown in FIGS. 5 and 8. It should thus be appreciated that such rotation of the pressing mechanism 130 allows the mechanism 130 to be oriented perpendicular to each of the legs 44*a*, 44*b* of the angle 44 in order to punch or drill a hole through the desired leg 44*a*, 44*b*.

(b) The earth plate 220 (and pressing mechanism 130) may also be moved linearly along the rails 134 (in the Y-axis direction in FIGS. 5 and 8 when stamping angle leg 44*a*; in the Z-axis direction in FIGS. 4 and 7 when stamping angle leg 44*b*) in order to position the pressing mechanism 130 so that its desired tool (e.g., punch, drill, or stamp) is laterally positioned relative to the angle 44 where desired (e.g., aligned with the center of the leg 44*a* or 44*b*, or near the bend 44*c*, or near the outer lateral edge of the leg 44*a* or 44*b* spaced furthest away from the bend 44*c*).

(c) Finally, the angle 44 itself may be moved in the X-axis direction to position the angle 44 longitudinally so that the area along its length where the particular operation (e.g., punching a hole) is to be done.

It should be appreciated that the above three ranges of motion will permit the desired tool to be positioned relative to virtually any location on the angle legs 44*a*, 44*b* so that it will be moved perpendicular to the surface of the angle 44 at that location when the pressing mechanism 130 is operated (e.g., in the Y or Z-axis directions) as described further below.

The pressing mechanism 130 of the illustrated embodiment is shown in greater detail in FIGS. 10-18. In particular, the overall structure of the mechanism 130 is illustrated in FIGS. 10-11 and 13*a*-16*b*, with suitable exemplary punch tools associated with the mechanism 130 illustrated in FIGS. 12, 17 and 18.

Referring first to the overall structure, the pressing mechanism 130 includes a top plate 300 and a bottom plate 304 which are suitably secured together so as to be substantially parallel to one another at a fixed spacing between them. Specifically, four spacing rods 310 are suitably secured to the corners of the top and bottom plates 300, 304 with, for example, the rods 310 on their bottom end threaded into threaded openings 314 in the bottom plate and collars 316 advantageously secured to the rods 310 above the top plate 300.

The earth plate 220 and a support plate 318 have aligned openings 322, 324 in their corners as well through which the rods 310 extend, whereby the earth plate 220 and the support plate 318 are both substantially parallel to the top and bottom plates 300, 304.

Guide sleeves 326, 328 may be advantageously provided in the plate openings 322, 324, and spacer sleeves 334, 336, 338 may be advantageously provided around the rods 310 to define the fixed spacing between the top and bottom plates 300, 304 (the combined length of the spacer sleeves 334, 336, 338 defining the spacing). Both the earth and support plates 220, 318 may move in the direction of the rods 310 (specifically over the long spacer sleeves 336) relative to the top and bottom plates 300, 304, as described further below. The bottom spacer sleeves 338 located between the earth plate 220 and the bottom plate 304 have larger diameters than the earth plate openings 324 so as to function as a spacer or stop defining a minimum spacing between the earth and bottom plates 220, 304.

Secured to (or integral with) the bottom of the support plate 318 is a drive cylinder 350 including a drive piston 354 (see, e.g., FIG. 14*b*) suitably secured (e.g., by metal screws 358) to the bottom plate 304. Compression springs 364 around the spacer sleeves 336 and between the earth and support plates 220, 318 bias the earth and support plates 220, 318 apart. Washers 366, 368 may be advantageously provided to allow the ends of the springs 364 to appropriately seat and twist, as need be, during movement of the earth and support plates 220, 318 relative to each other. It should be appreciated, however, that any structure for biasing the earth and support plates 220, 318 apart could be used within the broad scope of the present inventions. For example, not only could springs other than metal coil springs be used, but gas shocks or other structures providing the required biasing could also be used.

An outwardly extending flange 372 on the bottom of the drive cylinder 350 defines an upwardly facing shoulder and extends through a central opening 376 of the earth plate 220, and a pair of stop plates 380 are suitably secured (e.g., by metal screws 382) on opposite sides of the central opening 376 to define shoulders limiting the spacing between the earth and support plates 220, 318. That is, as shown for example in FIG. 15*b*, when the drive cylinder 350 is operated to allow the bottom and support plates 304, 318 to be separated, the support plate 318 will also move away from the earth plate 220 (as a result of the biasing force of the springs 364) until the flange 372 of the drive cylinder 350 engages the stop plates 380.

A support block, such as a die 390, is suitably secured (e.g., by metal screws 391) to the support plate 318. The die 390 includes a supporting member 392 which may be engaged with one side of the angle 44 during punching or drilling operations, and includes an opening 394 therein sized to cooperate with the tool (described further below) so that, for example, when a punching tool engages the angle 44 from the other side, the material removed from the angle 44 when the hole is punched out can be pushed through the opening 394. The supporting member 392 may be removably secured (e.g., by a set screw 396) to the die 390 to allow different supporting members 392 to be substituted for use with different workpiece or cutting tools 400 (see, e.g., FIGS. 12 and 18). Waste guides 398 may also be provided for receiving and guiding the removed material away from the die 390.

Figure 12:
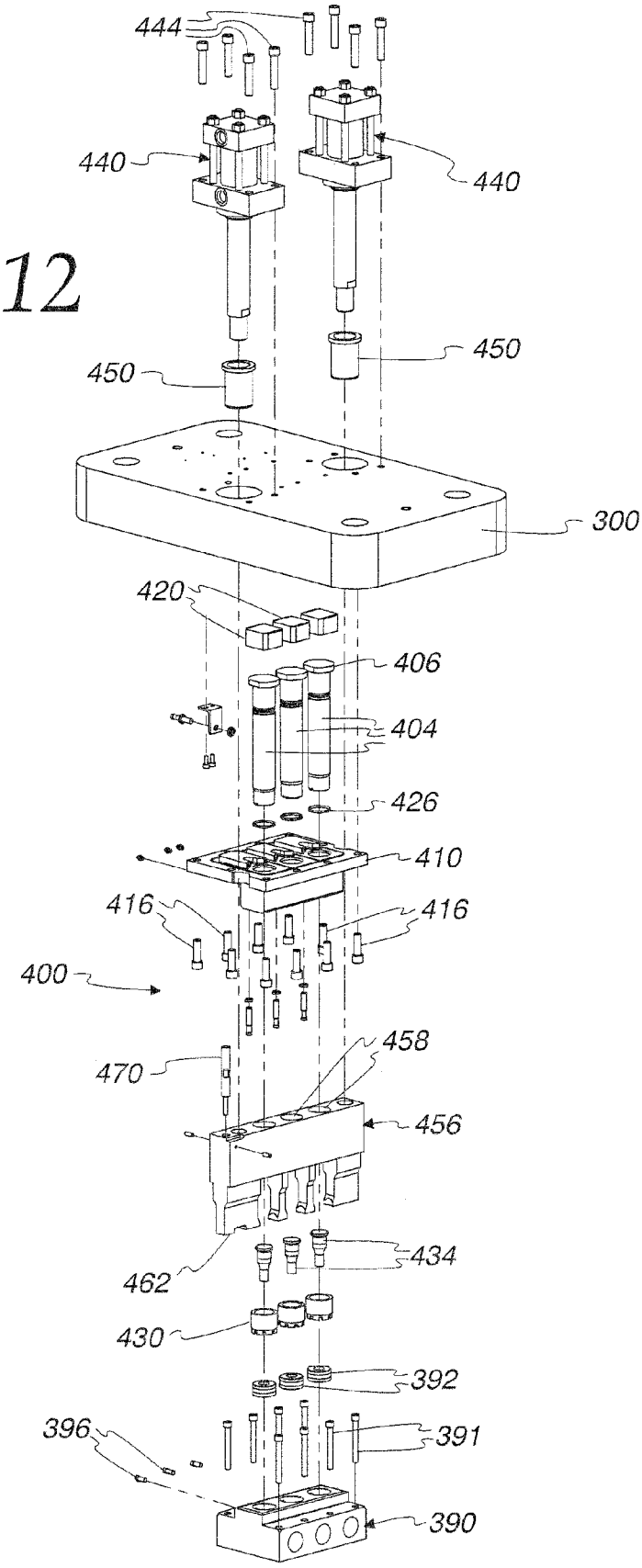
FIG. 12 is an exploded isometric view of a tool mounted to the top plate of the pressing mechanism of FIG. 10.
Figure 13D:
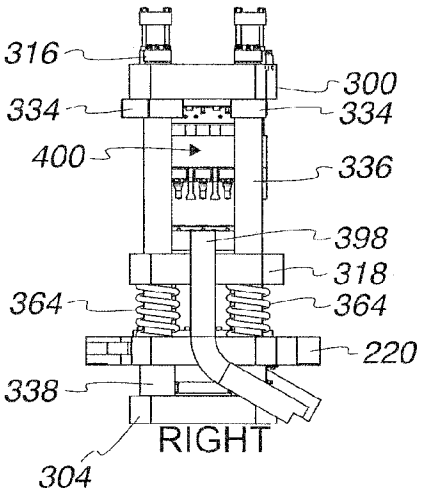
Figure 13A:
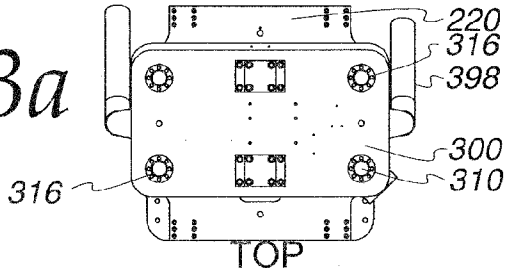
Figure 13C:
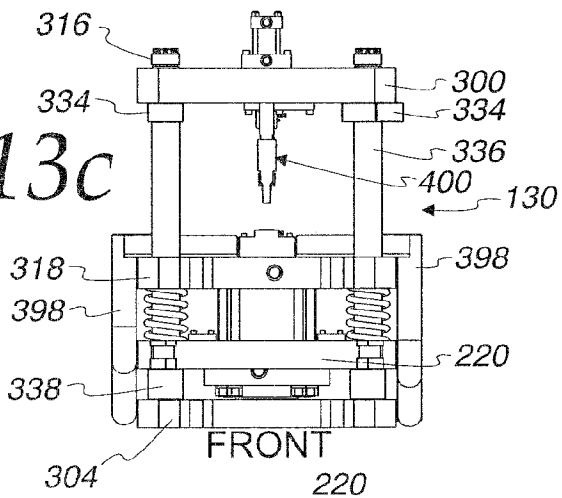
Figure 13E:
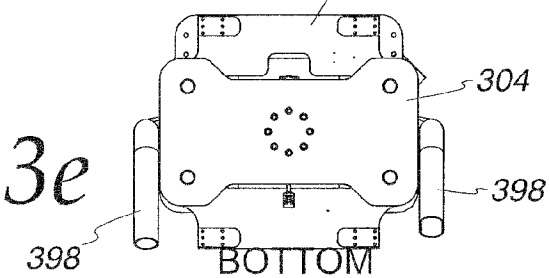
Figure 13B:
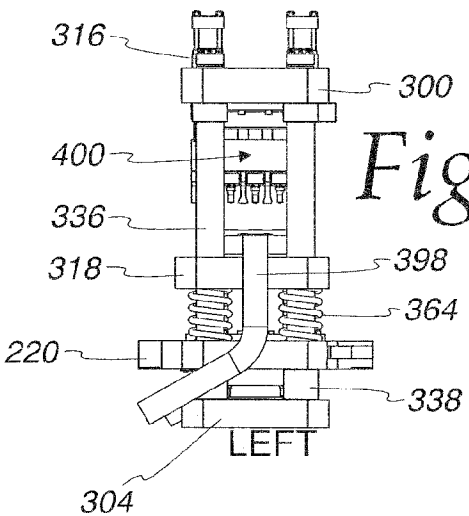
Figure 18:
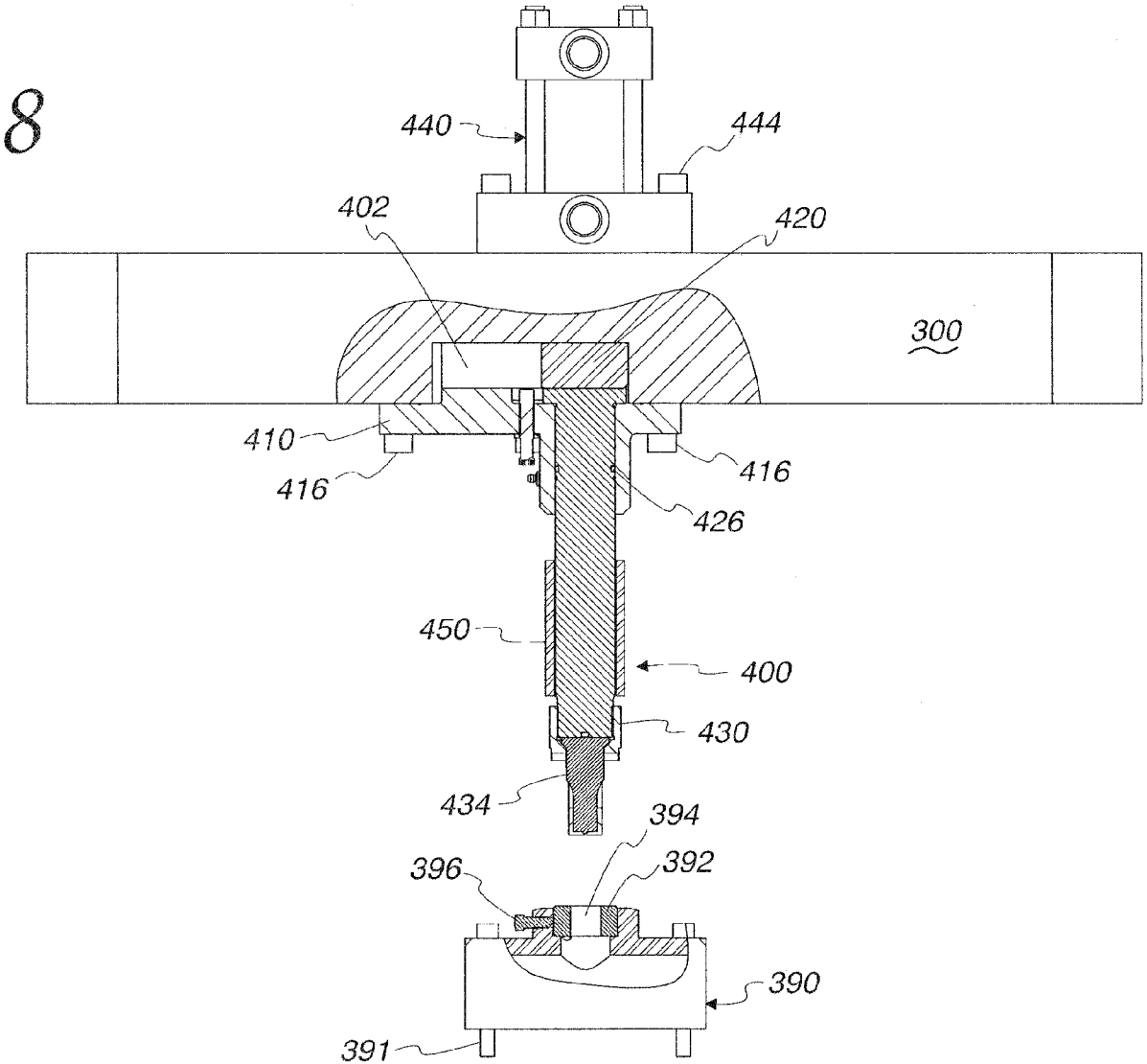
FIG. 18 is a side partially broken away cross-sectional view of the tool illustrated in FIG. 12.

An example of one tool 400 which may be used with the present invention is illustrated in FIGS. 12 and 18, which includes three punches which may be simultaneously, or individually, operated to create a hole in an angle 44.

In the FIGS. 12 and 18 structure, the tool 400 is secured to the top plate 300 and over a recess 402 in the top plate 300, and includes a three rams 404 each having heads 406 supported in a base 410 suitably secured (e.g., by metal screws 416) to the bottom of the top plate 300 (e.g., in a recess in the top plate 300).

Blocks 420 associated with each of the rams 404 are located in the recess 402 and each may be selectively moved (e.g., pneumatically) to an active punching position over the associated ram 404 (i.e., on the right as illustrated in FIG. 18) or to an inactive or neutral position (i.e., on the left in FIG. 18). The recess 402 is suitably sealed to facilitate operation of the blocks 420, including O-rings 426 over the rams 404. It should be appreciated that when a block 420 is in the inactive position, the associated punch ram 404 will be pushed back up into the top plate recess 402 when engaging the angle 44 rather than driving through the angle 44 to punch a hole. Thus, the pressing mechanism 130 may be operated so that any combination of the three rams 404 may be operated to punch holes at one time, depending on the position of the associated blocks 420.

Coupling nuts 430 suitably secure punch bits 434 to the ends of the rams 404, allowing different bits 434 to be used to allow for creation of different size and/or shape holes.

Hydraulic cylinders 440 are suitably secured (e.g., by metal screws 444) to the top of the top plate 300, each including piston rods 448 extending through sleeves 450 in the top plate 300 and secured on their bottom ends to a stripper 456 which includes guide openings 458 therethrough for supporting the rams 404. The hydraulic cylinders 440 operate to constantly push down on the stripper 456. When operated to punch holes (i.e., with one or more of the blocks 420 over their associated rams 404), the punch bit(s) 434 of the operable punch ram(s) 404 will extend beyond the stripper 456 to punch through a structural angle 44. However, the bottom 462 of the stripper 456 will engage the structural angle before punch bit(s) 434 of inoperable punch ram(s) 404 (i.e., those rams 404 whose associated blocks 420 are not aligned above them). It should thus also be appreciated that all three rams 404 could be inoperable, with the bottom 462 of the stripper 456 serving as a base against which the structural angle 44 would be held (e.g., if a character stamp supported on the support plate 318 were being pressed against the opposite side of the structural angle 44).

An adjustable rod 470 may also be provided on the stripper 456 to provide an adjustable proximity switch for the position of the stripper 456. For example, if the punch bit(s) 434 were intended to indent a mark, but not completely punch through, a structural angle 44, the rod 470 can be used as a position indicator which a suitable switch would recognize to cause the pressing together of the top plate 300 and support plate 318 to cease.

Figure 17:
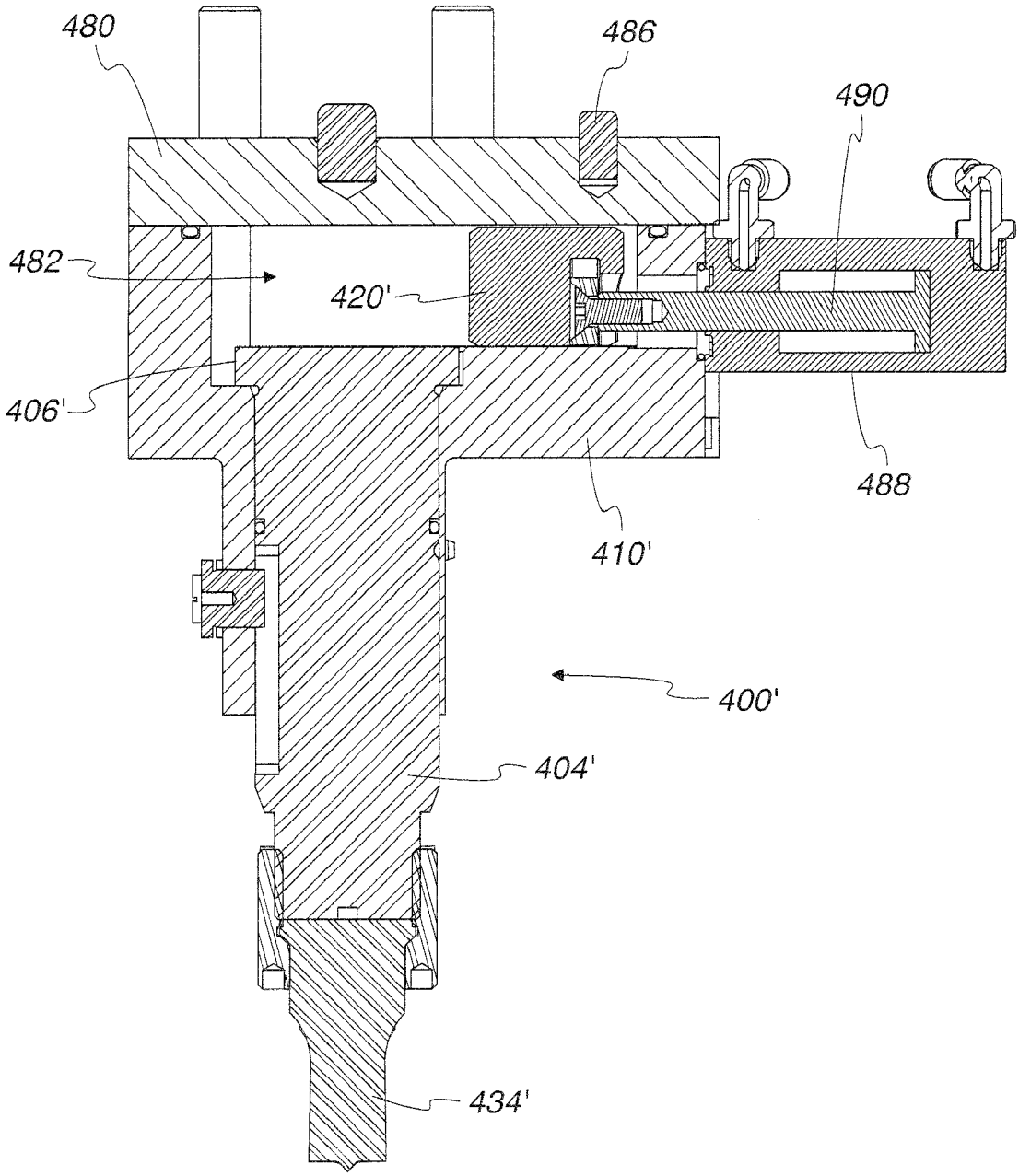
FIG. 17 is a side cross-sectional view of an alternate embodiment of a tool which may be used with the pressing mechanism of the present invention.

FIG. 17 discloses an alternate tool 400', wherein common components to those described in connection with the FIGS. 12 and 18 embodiment are given the same reference numeral, but with prime ("") added.

In the FIG. 17 embodiment, the base 410' is secured to a plate 480 defining a cavity 482 (similar to the top plate recess 402 integral with the top plate 300 of FIG. 18, though the cavity 482 need not be sealed against air leakage). The plate 480 may be suitably secured to the bottom of the top plate 300 (e.g., with alignment pins and screws 486). A separate pneumatic cylinder 488 has its piston rod 490 secured to the block(s) 420', whereby the block(s) 420' may be selectively positioned either clear of the head 406' of the punch ram 404' (as shown in FIG. 17) so that the punch is inoperable, or above the head 406' (i.e., moved to the left in FIG. 17) whereby the punch 404' would be operable to drive the punch bit 434' into the structural angle.

Notwithstanding the above descriptions of punching tools, it should be understood, that the present invention may be used with a punch press module or machine 60 which may have a variety of tools, including not only punches but also, for example, drills. Thus, it should be understood that the present invention may be advantageously used with virtually any tool which may be used to create a hole in a workpiece by moving the tool into the workpiece, and further may be used with still other tools which operate by pressing against a workpiece, including character stamps (such as disclosed in Applicant's own application filed concurrently herewith, entitled "Adjustable Character Stamp", the full disclosure of which is hereby incorporated by reference) as well as cutting blades. It should also be appreciated that a pressing mechanism 130 having a single drive may be used with a plurality of tools (e.g., thereby eliminating any need for multiple pressing structures for each tool).

Operation of the pressing mechanism 130 should thus be appreciated as follows, with particular reference to FIGS. 14*b*, 15*b*, and 16*b*.

When a hole is desired to be created at a particular location on a leg 44*a* or 44*b* of a structural angle 44:

a) the angle 44 is advanced in the direction of the X-axis to align desired longitudinal hole location of the angle 44 with the tool 400 to be used to create the hole;

b) the pressing mechanism 130 is rotated about the X-axis by the position control cylinder 170 so that the support plate 318 is parallel with the side of the angle leg 44*a* or 44*b* in which the hole is to be created (e.g., in the illustration of FIGS. 14*b*, 15*b* and 16*b*, the leg to be punched (44*a*) and the support plate 318 are both parallel to the Y-axis, with the rods 310 of the mechanism 130 parallel to the Z-axis; and c) the pressing mechanism 130 is moved linearly along the tracks 200 on the rails 134 by the servo motor driven ball screw 224 so that the die 390 and tool 400 are properly aligned in order to create a hole at the desired lateral position on the angle leg 44*a* or 44*b* (e.g., properly aligned in the direction of the Y-axis when creating a hole in leg 44*a* as illustrated in FIGS. 14*b*, 15*b* and 16*b*).

Once properly aligned as described above, the pressing mechanism may be operated to create a hole in the angle leg 44*a* or 44*b* as follows. In the below description, it should be appreciated that the earth plate 220 is so characterized as being "earth" because the earth plate 200 is, in any given position on its tracks 136, 200, fixed relative to the angle 44. That is, it should be appreciated that the position of the angle 44 and the earth plate 220 relative to each other is fixed throughout the entire punching operation described in connection with FIGS. 14*b*, 15*b* and 16*b*.

In the FIG. 14*b* configuration, the rail 134 of the pressing mechanism 130 is oriented as illustrated in FIGS. 5 and 8 (with the Y- and Z-axes as indicated), but the pressing mechanism 130 is moved along the track 200 in the Y-axis direction from the FIG. 8 position so that the tool 400 is positioned so that it is aligned along the Z-axis with the location on the angle leg 44*a* where the hole is to be punched. (FIGS. 15*b* and 16*b* are in the same orientation, but with different positions of the pressing mechanism 130 as discussed in detail below.)

Thus, the tool 400 in the FIG. 14*b* may be used to punch a hole in the angle leg 44*a* by forcing suitable fluid (e.g., oil) into the cylinder 350 above the drive piston 354, which will begin to separate the bottom and support plates 304, 318. Since the bottom plate 304 is positioned against the stop or spacer sleeves 338 (it being held up against it through its securement to the support plate 318 and the upward bias of the compression springs 364), it cannot move up closer to the earth plate 220. As a result, as the cylinder 350 drives the bottom and support plates 304, 318 further apart, the compression springs 364 cooperate with the cylinder 350 to move the support plate 318 up (in the illustration orientation of FIGS. 14*b*, 15 and 16*b*) away from the earth plate 220.

Once the support plate 318 reaches the position at which its flange 372 engages the stop plates 380 on the earth plate 220, the support plate 318 and its supported die 390 can move no closer to the angle 44 (see FIG. 15*b*). In fact, the spacing is specifically provided so that in this position (with the cylinder flange 372 engaging the stop plates 380 of the earth plate 220) the die 390 will be positioned with its supporting member 392 substantially against the side of the angle 44 (angle leg 44*a* in FIGS. 14*b*, 15*b* and 16*b*).

At this point, further driving by the cylinder 350 to separate the support plate 318 and the bottom plate 304 will push the bottom plate 304 down relative to the support plate 318 and also away from the earth plate 220 (whereby the stop or spacer sleeve 338 will pull down away from the earth plate 220) as illustrated in FIG. 16*b*. Moreover, since the top plate 300 is a fixed distance from the bottom plate 304 as previously discussed, driving the bottom plate 304 down also drives the top plate 304 and the tool 400 on the top plate 304 down, whereby the tool 400 will be pressed through the angle 44 and into the die 390 so as to create a hole in the angle 44 as desired.

In short, it should be appreciated that the single drive cylinder 350 may be advantageously used to both raise up the die 390 against one side of the angle 44 and then drive down the tool 400 against and through the other side of the angle 44 to create the desired hole.

Once the desired hole is created in the angle 44 (e.g., in angle leg 44*a* in FIG. 16*b*), the fluid injected above the drive piston 354 may be released and fluid may be injected beneath the drive piston 354 to start forcing the support and bottom plates 318, 304 together. When this occurs, the springs 364 will initially hold the support plate 318 up (with the cylinder flange 372 engaging the stop plates 380), with the reducing distance between the support and bottom plates 318, 304 causing the bottom plate 304 to raise up and carry the top plate 300 with it so that the tool 400 is retracted up away from the angle 44. Once the spacing between the earth and bottom plates 220, 304 has reached the limit defined by the stop or spacer sleeves 338 (as in FIG. 15*b*), further movement together of the support and bottom plates 318, 304 causes the support plate 318 to be moved down (against the biasing force of the compression springs 364) so that the die 390 is retracted clear of the angle 44.

It should be appreciated that while the rotary motion of the pressing mechanism 300 may advantageously allow the use of a single drive to work on workpieces having surfaces oriented in more than one plane (e.g., a structural angle such as described herein), such motion may also allow a pressing mechanism to be advantageously used even with workpieces having only one surface requiring working. For example, in a processing system 40 which may handle structural angles 44 such as described herein, an operator may load a workpiece which is flat stock into the system 40 in either orientation (i.e., oriented as leg 44*a*, or oriented as leg 44*b*), and the system 40 may accommodate either orientation while still having only one pressing mechanism 300.

It should thus further be appreciated that structures incorporating the present invention such as described above may be operated quickly and efficiently, with precise relative positioning of holes relative to each other. Still further, such machines may provide such operation while also requiring reduced numbers of components and therefore being available at minimal cost.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A machine for pressing a workpiece tool against a workpiece in the direction of a first axis, said machine comprising:

an earth plate oriented substantially perpendicular to the first axis and adapted to be selectively positioned at a fixed position relative to said workpiece when pressing a tool toward the workpiece;

a top plate oriented substantially parallel to said earth plate and adapted to mount a workpiece tool thereto;

a bottom plate oriented substantially parallel to said earth plate and spaced a fixed distance in the direction of the first axis from the top plate, said top and bottom plates supported for movement relative to the earth plate in the direction of the first axis;

a support plate between the earth plate and the top plate and supported for movement relative to the earth plate in the direction of the first axis, said support plate being adapted to mount a support block thereto;

means for biasing said support plate away from said earth plate and toward said top plate;

a first stop limiting movement of said bottom plate toward said earth plate;

a second stop limiting movement of said support plate away from said earth plate; and a drive adapted to selectively move said support and bottom plates away from each other in the direction of the first axis.

2. The machine of claim 1, wherein said biasing means holds said bottom plate against said first stop until said drive moves said support plate to its limit away from said earth plate after which said bottom plate is driven away from said earth plate to move said top plate toward said support plate.

3. The machine of claim 2, wherein said support plate engages said second stop when the support block is adjacent said workpiece.

4. The machine of claim 1, wherein said drive comprises a cylinder secured to said support plate and a piston secured to said bottom plate, said cylinder engaging said second stop to limit movement of said support plate away from said earth plate, and said drive when operated in reverse moves said support plate and said bottom plate toward each other whereby said bottom plate is first brought into engagement with said first stop after which said drive cylinder is retracted from said second stop and said support plate is moved toward said earth plate against the biasing means.

5. The machine of claim 1, wherein the support block on said support plate is adapted to cooperate with a workpiece tool mounted to the top plate to modify the workpiece when said tool and said support block are brought together.

6. The machine of claim 5, wherein:

the workpiece is modified by the addition of a hole therein;

said support block is a die adapted to substantially engage one side of the workpiece when said support plate engages said second stop; and said workpiece tool comprises a punch driven through said workpiece from the other side when said drive moves said support plate and bottom plate away from each other.

7. The machine of claim 1, wherein said machine further comprises:

a support frame having tracks arcuate about a second axis;

rails supported on said arcuate tracks for selective rotation about the second axis, said rails supporting said earth plate whereby when rotated said first axis remains substantially perpendicular to said second axis; and in said selected fixed positions of said earth plate, said first axis is substantially perpendicular to surface of the workpiece toward which the tool is biased.

8. The machine of claim 7, wherein said earth plate is supported for selective linear motion along said rails in the direction of a third axis, said third axis being substantially perpendicular to both said first and second axes in all selected rotational positions of said rails.

9. The machine of claim 1, wherein said drive comprises a piston and cylinder extending between said support and bottom plates.

10. The machine of claim 9, wherein said piston is secured to said bottom plate and said cylinder is secured to said support plate whereby extending said cylinder drives said bottom and support plates apart.

11. The machine of claim 10, wherein said cylinder and piston extend through an opening in said earth plate;

said second stop comprises a first shoulder around said earth plate opening; and said cylinder having an outwardly extending second shoulder adapted to engage said earth plate first shoulder when said support plate is at a predetermined position.

12. The machine of claim 11, wherein said predetermined position is the position at which the support block on the support plate substantially engages one side of the workpiece.

13. The machine of claim 1, further comprising a plurality of rods interconnecting corners of the top and bottom plates, wherein said support and earth plates are slidably supported on said rods.

14. The machine of claim 13, wherein said biasing means comprises compression springs on said rods between said earth and support plates.

15. A machine for pressing a workpiece tool against a workpiece in the direction of a first axis, said machine comprising:

an earth plate adapted to be selectively positioned at a fixed position relative to said workpiece when the tool is pressed toward the workpiece;

top and bottom plates spaced apart a fixed distance in the direction of the first axis and supported for movement relative to the earth plate in the direction of the first axis when said earth plate is positioned at the fixed position, said top plate being adapted to mount a tool;

a support plate between the earth plate and the top plate and supported for movement relative to the earth plate in the direction of the first axis when said earth plate is positioned at the fixed position, said support plate being adapted to mount a support block thereto;

means for biasing said support plate away from said earth plate and toward said top plate in the direction of the first axis;

a first stop limiting movement of said bottom plate toward said earth plate;

a second stop limiting movement of said support plate away from said earth plate; and a drive adapted to selectively move said support plate and said bottom plate in the direction of the first axis relative to each other;

whereby when said drive moves said support plate and said bottom plate toward each other with said bottom plate engaging said first stop, said support plate is moved toward said earth plate, when said drive moves said support plate and said bottom plate away from each other, said support plate is first moved to its limit away from said earth plate and then said bottom plate is moved away from said earth plate to move said top plate toward said support plate.

16. The machine of claim 15, wherein said bottom plate, earth plate, support plate and top plate are all oriented substantially perpendicular to the first axis.

17. The machine of claim 15, wherein the support block on said support plate is adapted to cooperate with a workpiece tool mounted to the top plate to modify the workpiece when said tool and said support block are brought together.

18. The machine of claim 17, wherein:

the workpiece is modified by the addition of a hole therein;

said support block is a die adapted to substantially engage one side of the workpiece when said support plate engages said second stop; and said workpiece tool comprises a punch driven through said workpiece from the other side when said drive moves said support plate and bottom plate away from each other.

19. The machine of claim 15, wherein said drive comprises a piston and cylinder extending between said support and bottom plates.

20. The machine of claim 19, wherein said piston is secured to said bottom plate and said cylinder is secured to said support plate whereby extending said cylinder drives said bottom and support plates apart.

21. The machine of claim 20, wherein said cylinder and piston extend through an opening in said earth plate;

said second stop comprises a first shoulder around said earth plate opening; and said cylinder having an outwardly extending second shoulder adapted to engage said earth plate first shoulder when said support plate is at a predetermined position.

22. The machine of claim 21, wherein said predetermined position is the position at which the support block on the support plate substantially engages one side of the workpiece.

23. The machine of claim 15, wherein in said fixed position, said first axis is oriented perpendicular to a surface of the workpiece.

24. The machine of claim 15, further comprising a plurality of rods interconnecting corners of the top and bottom plates, wherein said support and earth plates are slidably supported on said rods.

25. The machine of claim 24, wherein said biasing means comprises compression springs on said rods between said earth and support plates.

26. The machine of claim 15, wherein said machine further comprises:

a support frame having tracks arcuate about a second axis;

rails supported on said arcuate tracks for selective rotation about the second axis, said rails supporting said earth plate whereby when rotated said first axis remains substantially perpendicular to said second axis.

27. The machine of claim 26, wherein said earth plate is supported for selective linear motion along said rails in the direction of a third axis, said third axis being substantially perpendicular to both said first and second axes in all selected rotational positions of said rails.

28. The machine of claim 15, wherein said workpiece tool comprises a punch.

29. The machine of claim 15, wherein said workpiece tool comprises a plurality of punches supported on said top plate.

* * * * *